US009983507B1

(12) United States Patent
Park et al.

(10) Patent No.: US 9,983,507 B1
(45) Date of Patent: May 29, 2018

(54) DEVELOPER CARTRIDGE AND ELECTROPHOTOGRAPHIC IMAGE FORMING APPARATUS EMPLOYING THE SAME

(71) Applicant: S-Printing Solution Co., Ltd., Suwon-si (KR)

(72) Inventors: Jong-hyun Park, Hwaseong-si (KR); Se-il Kwon, Yongin-si (KR); Dong-uk Kim, Hwaseong-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days. days.

(21) Appl. No.: 15/632,967

(22) Filed: Jun. 26, 2017

(30) Foreign Application Priority Data

Nov. 14, 2016 (KR) ..... 10-2016-0151309

(51) Int. Cl.

| | |
|---|---|
| ***G03G 15/08*** | (2006.01) |
| ***G03G 15/00*** | (2006.01) |
| ***G03G 21/18*** | (2006.01) |
| ***G03G 21/12*** | (2006.01) |

(52) U.S. Cl.
CPC ..... *G03G 15/0834* (2013.01); *G03G 15/0865* (2013.01); *G03G 15/0874* (2013.01); *G03G 15/757* (2013.01); *G03G 21/12* (2013.01); *G03G 21/1857* (2013.01)

(58) Field of Classification Search
CPC ..... G03G 15/0832; G03G 15/0834; G03G 15/0865; G03G 15/0874; G03G 15/757; G03G 21/1857; G03G 21/12; G03G 2215/0682; G03G 2215/0685; G03G 2215/085
USPC ..... 399/262
See application file for complete search history.

(56) References Cited

U.S. PATENT DOCUMENTS

| | | | | |
|---|---|---|---|---|
| 5,084,734 | A * | 1/1992 | Yoshino | G03G 21/12 222/DIG. 1 |
| 9,134,651 | B1 | 9/2015 | Eto | |
| 9,146,502 | B1 | 9/2015 | Eto | |
| 9,229,366 | B2 | 1/2016 | Shibata | |
| 9,244,384 | B2 | 1/2016 | Nakamura et al. | |
| 9,261,819 | B1 | 2/2016 | Makie | |
| 9,268,260 | B2 | 2/2016 | Eto | |
| 9,304,436 | B2 | 4/2016 | Eto | |
| 9,348,260 | B2 | 5/2016 | Eto | |
| 9,354,547 | B2 | 5/2016 | Konishi et al. | |
| 9,383,679 | B2 | 7/2016 | Eto | |
| 9,383,680 | B2 | 7/2016 | Eto | |
| 9,395,650 | B2 | 7/2016 | Eto et al. | |
| 9,395,651 | B2 | 7/2016 | Konishi et al. | |
| 9,411,267 | B2 | 8/2016 | Nakaue et al. | |

(Continued)

FOREIGN PATENT DOCUMENTS

| | | |
|---|---|---|
| EP | 1367459 A1 | 12/2003 |
| JP | 2005-338397 A | 12/2005 |

*Primary Examiner* — Sophia S Chen
(74) *Attorney, Agent, or Firm* — Staas & Halsey LLP

(57) ABSTRACT

A developer cartridge includes a housing including a developer discharger having a developer outlet, and a container extending from the developer discharger, a movable member located in the container and movable in a direction of changing a volume of the container, and a flexible containing member configured in a bag shape having at least one open end connected to a wall of the container and another end connected to the movable member.

20 Claims, 31 Drawing Sheets

(56) References Cited

U.S. PATENT DOCUMENTS

| | | | | |
|---|---|---|---|---|
| 2007/0223972 | A1* | 9/2007 | Isomura | G03G 15/0874 399/262 |
| 2015/0185660 | A1 | 7/2015 | Shibata | |
| 2016/0033900 | A1 | 2/2016 | Eto | |

* cited by examiner

DEVELOPER CARTRIDGE AND ELECTROPHOTOGRAPHIC IMAGE FORMING APPARATUS EMPLOYING THE SAME

CROSS-REFERENCE TO RELATED APPLICATION

This application claims the benefit of Korean Patent Application No. 10-2016-0151309, filed on Nov. 14, 2016, in the Korean Intellectual Property Office, the disclosure of which is incorporated herein in its entirety by reference.

BACKGROUND

1. Field

The following description relates to developer cartridges and electrophotographic image forming apparatuses employing the same.

2. Description of the Related Art

An image forming apparatus using electrophotography forms a visible toner image on a photoconductor by supplying a toner to an electrostatic latent image formed on the photoconductor, transfers the toner image onto a recording medium, and then fixes the transferred toner image on the recording medium, thereby printing an image on the recording medium. A developing unit contains a developer (toner) and forms the visible toner image on the photoconductor by supplying the toner to the electrostatic latent image formed on the photoconductor.

The developer may be contained in a developer cartridge. The developer may be supplied from the developer cartridge to the developing unit. The developer cartridge includes a container for containing the developer, and an outlet for discharging the developer. A paddle for carrying the developer to the outlet is provided in the container. The outlet is generally provided at a length-direction side of the container. The paddle has a length corresponding to the length of the container. When the developer near the outlet is supplied to the developing unit and thus the amount of the developer varies in a length direction, a load applied to the paddle by the developer may not be uniform in the length direction and thus a paddle shaft may be damaged. In addition, because the paddle rotates by scraping an internal wall of the container, a driving load of the paddle is large. Furthermore, when the paddle is continuously driven, stress may accumulate in the developer contained in the container and thus properties of the developer may deteriorate. In addition, although an empty space is generated in the container when the developer is consumed, because this empty space is not usable, space usability of the developer cartridge and the image forming apparatus is low.

SUMMARY

Provided are developer cartridges capable of reducing a driving load of a member for stirring a developer, and electrophotographic image forming apparatuses employing the same.

Provided are developer cartridges capable of reducing developer stress, and electrophotographic image forming apparatuses employing the same.

Provided are developer cartridges having improved space usability, and electrophotographic image forming apparatuses employing the same.

Additional aspects will be set forth in part in the description which follows and, in part, will be apparent from the description, or may be learned by practice of the presented embodiments.

According to an aspect of an embodiment, a developer cartridge includes a housing including a developer discharger having a developer outlet, and a container extending from the developer discharger, a movable member located in the container and movable in a direction of changing a volume of the container, and a flexible containing member configured in a bag shape having at least one open end connected to a wall of the container and another end connected to the movable member.

According to an aspect of an embodiment, an electrophotographic image forming apparatus includes a body and the above developer cartridge.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
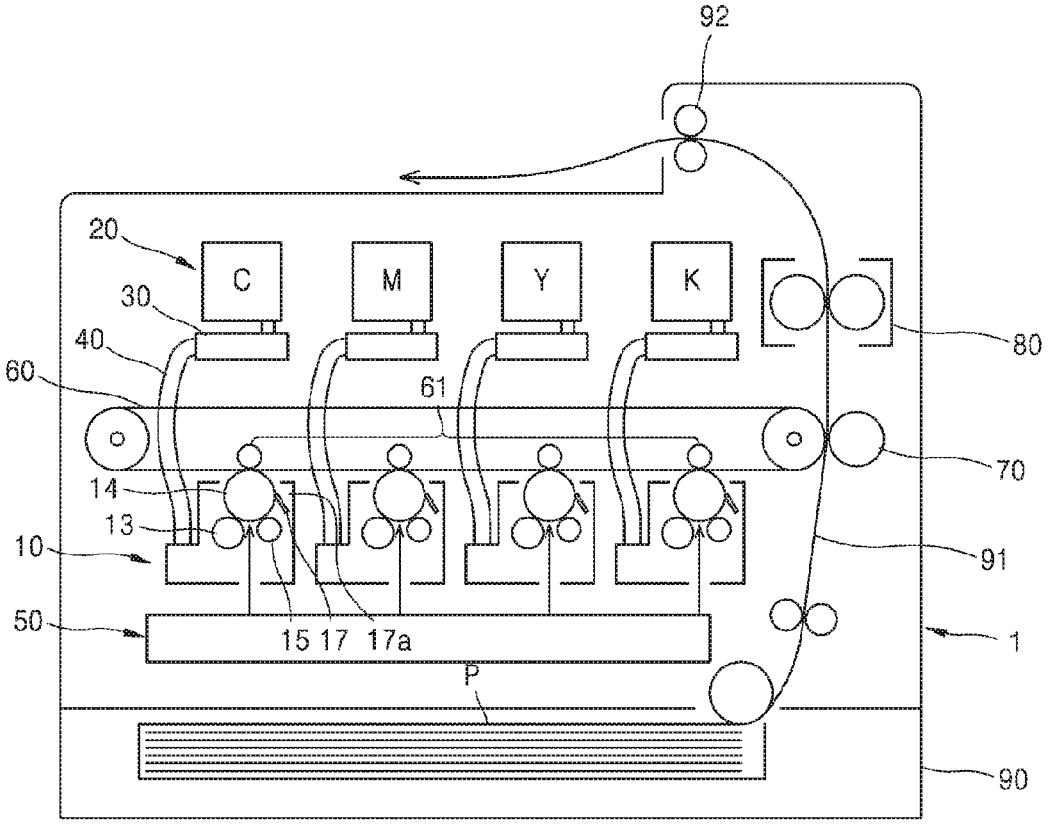
FIG. 1 is a structural view of an electrophotographic image forming apparatus according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects. As used herein, the term "and/or" includes any and all combinations of one or more of the associated listed items.

FIG. 1 is a structural view of an electrophotographic image forming apparatus 1 according to an embodiment. The image forming apparatus according to the current embodiment prints color images using electrophotography. Referring to FIG. 1, the image forming apparatus includes a plurality of developing units 10 and a plurality of developer cartridges 20 for containing developers. The developer cartridges 20 are also called 'toner cartridges'. The developer cartridges 20 are separately connected to the developing units 10, and the developers contained in the developer cartridges 20 are separately supplied to the developing units 10. The developer cartridges 20 and the developing units 10 may be individually replaced.

The developing units 10 include a plurality of developing units 10C, 10M, 10Y, and 10K for developing cyan (C), magenta (M), yellow (Y), and black (K) developers, respectively. The developer cartridges 20 may include a plurality of developer containers 20C, 20M, 20Y, and 20K for separately containing the C, M, Y, and K developers to be supplied to the developing units 10C, 10M, 10Y, and 10K. However, the scope of the present disclosure is not limited thereto, and the image forming apparatus may further include a plurality of developer cartridges 20 and a plurality of developing units 10 for containing and developing developers of various colors other than the above-mentioned colors, e.g., light magenta and white. In the following description, it is assumed that the image forming apparatus includes the developing units 10C, 10M, 10Y, and 10K and the developer cartridges 20C, 20M, 20Y, and 20K, and C, M, Y, and K following reference numerals denote elements for developing cyan, magenta, yellow, and black developers, respectively, unless the context clearly indicates otherwise.

Each developing unit 10 may include a photosensitive drum 14 for forming an electrostatic latent image on the surface thereof, and a developing roller 13 for developing the electrostatic latent image into a visible toner image by supplying the developer from the developer cartridge 20 to the electrostatic latent image. The photosensitive drum 14 is an example of a photoconductor for forming an electrostatic latent image on the surface thereof, and may include a conductive metal pipe, and a photosensitive layer provided on an outer circumferential surface of the conductive metal pipe. A charging roller 15 is an example of a charger for charging the photosensitive drum 14 to have a uniform surface potential. A charging brush, a corona charger, or the like may be employed instead of the charging roller 15.

The developing unit 10 may further include a charging roller cleaner (not shown) for removing a foreign substance adhered to the charging roller 15, e.g., the developer or dust, a cleaning member 17 for removing the developer remaining on the surface of the photosensitive drum 14 after an intermediate transfer operation to be described below, and a regulation member (not shown) for regulating the amount of the developer supplied to a developing area where the photosensitive drum 14 and the developing roller 13 face each other.

When a two-component development scheme is employed, the developer contained in the developer cartridge 20 may be a toner. A carrier may be contained in the developing unit 10. The developing roller 13 is spaced apart from the photosensitive drum 14 by several ten to several hundred microns. Although not shown in FIG. 1, the developing roller 13 may be a magnetic roller or may be configured as a magnetic roller surrounded by a developing sleeve. The toner is mixed with the carrier in the developing unit 10, and is adhered to the surface of the magnetic carrier. The magnetic carrier is adhered to the surface of the developing roller 13 and is carried to the developing area where the photosensitive drum 14 and the developing roller 13 face each other. Due to a developing bias voltage applied between the developing roller 13 and the photosensitive drum 14, only the toner is supplied to the photosensitive drum 14 and thus the electrostatic latent image formed on the surface of the photosensitive drum 14 is developed into a visible image.

When a two-component development scheme is employed, the developer contained in the developer cartridge 20 may include a toner and a carrier. In this case, to constantly maintain a ratio of the carrier to the toner in the developing unit 10, a surplus amount of the carrier may be discharged outside the developing unit 10, and mat be contained in a waste developer container.

When a one-component development scheme using no carrier is employed, the developing roller 13 and the photosensitive drum 14 may rotate in contact with each other or apart from each other by several ten to several hundred microns. The developer contained in the developer cartridge 20 may be a toner.

A developing scheme of the image forming apparatus according to an embodiment has been described above in detail. However, the developing scheme is not limited thereto and may be variously changed or modified.

An exposer 50 is an element for forming electrostatic latent images on the photosensitive drums 14 by irradiating light modulated to correspond to image information, onto the photosensitive drums 14. A representative example thereof is a laser scanning unit (LSU) using a laser diode as a light source, or a light-emitting diode (LED) exposer using an LED as a light source.

An intermediate transfer belt 60 temporarily contains toner images developed on the photosensitive drums 14 of the developing units 10C, 10M, 10Y, and 10K. A plurality of intermediate transfer rollers 61 are provided to face the photosensitive drums 14 of the developing units 10C, 10M, 10Y, and 10K interposing the intermediate transfer belt 60 therebetween. An intermediate transfer bias voltage for intermediately transferring the toner images developed on the photosensitive drums 14, onto the intermediate transfer belt 60 is applied to the intermediate transfer rollers 61. Corona transferers or pin-scorotron transferers may be employed instead of the intermediate transfer rollers 61.

A transfer roller 70 is located to face the intermediate transfer belt 60. A transfer bias voltage for transferring the toner images transferred onto the intermediate transfer belt 60, onto a recording medium P is applied to the transfer roller 70.

A fuser 80 applies heat and/or pressure to the toner images transferred onto the recording medium P, and thus fixes the toner images on the recording medium P. The fuser 80 is not limited to the configuration illustrated in FIG. 1.

Due to the above-described configuration, the exposer 50 forms electrostatic latent images on the photosensitive drums 14 of the developing units 10C, 10M, 10Y, and 10K by irradiating light modulated to correspond to image information of a plurality of colors, onto the photosensitive drums 14. The electrostatic latent images of the photosensitive drums 14 of the developing units 10C, 10M, 10Y, and 10K are developed into visible toner images due to the C, M, Y, and K developers supplied from the developer cartridges 20C, 20M, 20Y, and 20K to the developing units 10C, 10M, 10Y, and 10K. The developed toner images are sequentially and intermediately transferred onto the intermediate transfer belt 60. The recording medium P accommodated in a feeding member 90 is fed along a feeding path 91 and is supplied between the transfer roller 70 and the intermediate transfer belt 60. The toner images intermediately transferred onto the intermediate transfer belt 60 are transferred onto the recording medium P due to a transfer bias voltage applied to the transfer roller 70. After the recording medium P passes through the fuser 80, the toner images are fixed on the recording medium P due to heat and pressure. The recording medium P, on which the toner images are completely fixed, is discharged by discharge rollers 92.

The developer contained in the developer cartridge 20 is supplied to the developing unit 10. When the developer contained in the developer cartridge 20 is completely consumed, the developer cartridge 20 may be replaced with a new developer cartridge 20, or a new developer may be filled in the developer cartridge 20.

The image forming apparatus may further include developer supply units 30. Each developer supply unit 30 receives the developer from the developer cartridge 20 and supplies the same to the developing unit 10. The developer supply unit 30 may be connected through a supply tube 40 to the developing unit 10.

Although not shown in FIG. 1, the developer supply unit 30 may be omitted and the supply tube 40 may directly interconnect the developer cartridge 20 and the developing unit 10.

Figure 2:
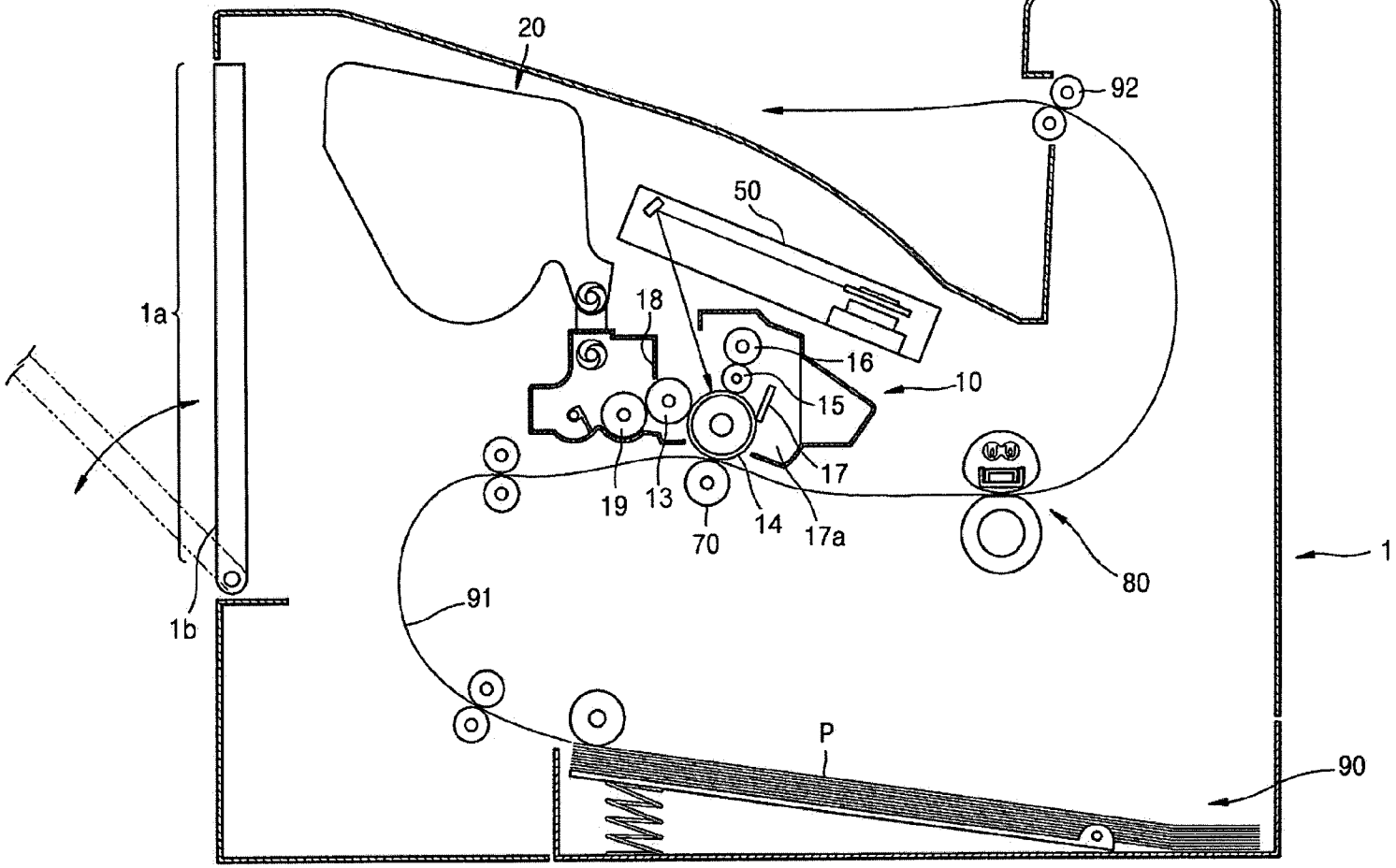
FIG. 2 is a structural view of an electrophotographic image forming apparatus according to an embodiment.

FIG. 2 is a structural view of an electrophotographic image forming apparatus according to an embodiment. The electrophotographic image forming apparatus according to the current embodiment is a monochromatic image forming apparatus. FIG. 2 illustrates an image forming apparatus body 1 and a developing unit 10. The body 1 includes an opening 1*a* for providing a path through which the developing unit 10 is attached or detached. A cover 1*b* opens or closes the opening 1*a*. An exposer 50, a transfer roller 70, and a fuser 80 are provided in the body 1. In addition, a feeding member 90 for accommodating and feeding a recording medium P on which an image is to be formed is provided in the body 1.

The developing unit 10 may include a photosensitive drum 14 for forming an electrostatic latent image on the surface thereof, and a developing roller 13 for developing the electrostatic latent image into a visible toner image by supplying a toner to the electrostatic latent image. A charging roller 15 is an example of a charger for charging the photosensitive drum 14 to have a uniform surface potential. A charging brush, a corona charger, or the like may be employed instead of the charging roller 15. Reference numeral 16 indicates a cleaning roller for removing a foreign substance adhered to the surface of the charging roller 15. A cleaning blade 17 is an example of a cleaning member for removing a foreign substance and a developer remaining on the surface of the photosensitive drum 14 after a transfer operation to be described below. Another type of a cleaning device, e.g., a brush, may be employed instead of the cleaning blade 17. The waste developer removed by the cleaning blade 17 is contained in a waste developer container 17*a*.

The developing unit 10 according to the current embodiment employs a one-component development scheme. The developer contained in a developer cartridge 20 may be a toner. The developing roller 13 is used to supply the toner to the photosensitive drum 14. A developing bias voltage for supplying the toner to the photosensitive drum 14 may be applied to the developing roller 13. The developing roller 13 and the photosensitive drum 14 may rotate in contact with each other or apart from each other by several ten to several hundred microns. A regulation member 18 regulates the amount of the toner supplied by the developing roller 13 to a developing area where the photosensitive drum 14 and the developing roller 13 face each other. The regulation member 18 may be a doctor blade resiliently contacting the surface of the developing roller 13. A supply roller 19 supplies the toner in the developing unit 10 to the surface of the developing roller 13. To this end, a supply bias voltage may be applied to the supply roller 19.

The developer cartridge 20 may be attached to the body 1 or the developing unit 10. The developer cartridge 20 may be replaced independently of the developing unit 10. The developer cartridge 20 may be directly connected to the developing unit 10.

The exposer 50 forms an electrostatic latent image on the photosensitive drum 14 by irradiating light modulated to correspond to image information, onto the photosensitive drum 14. An LSU using a laser diode as a light source, or an LED exposer using an LED as a light source may be employed as the exposer 50.

The transfer roller 70 is an example of a transferer for transferring the toner image from the photosensitive drum 14 onto the recording medium P. A transfer bias voltage for transferring the toner image onto the recording medium P is applied to the transfer roller 70. A corona transferer or a pin-scorotron transferer may be employed instead of the transfer roller 70.

The fuser 80 applies heat and pressure to the image transferred onto the recording medium P, and thus fixes the image on the recording medium P. The recording medium P having passed through the fuser 80 is discharged outside the body 1 by discharge rollers 92.

Due to the above-described configuration, the exposer 50 forms an electrostatic latent image on the photosensitive drum 14 by irradiating light modulated to correspond to image information, onto the photosensitive drum 14. The developing roller 13 forms a visible toner image on the surface of the photosensitive drum 14 by supplying the toner to the electrostatic latent image. The recording medium P accommodated in the feeding member 90 is fed along a feeding path 91 and is supplied between the transfer roller 70 and the photosensitive drum 14. The toner image is transferred from the photosensitive drum 14 onto the recording medium P due to a transfer bias voltage applied to the transfer roller 70. After the recording medium P passes through the fuser 80, the toner image is fixed on the recording medium P due to heat and pressure. The recording medium P, on which the toner image is completely fixed, is discharged by the discharge rollers 92.

Figure 3:
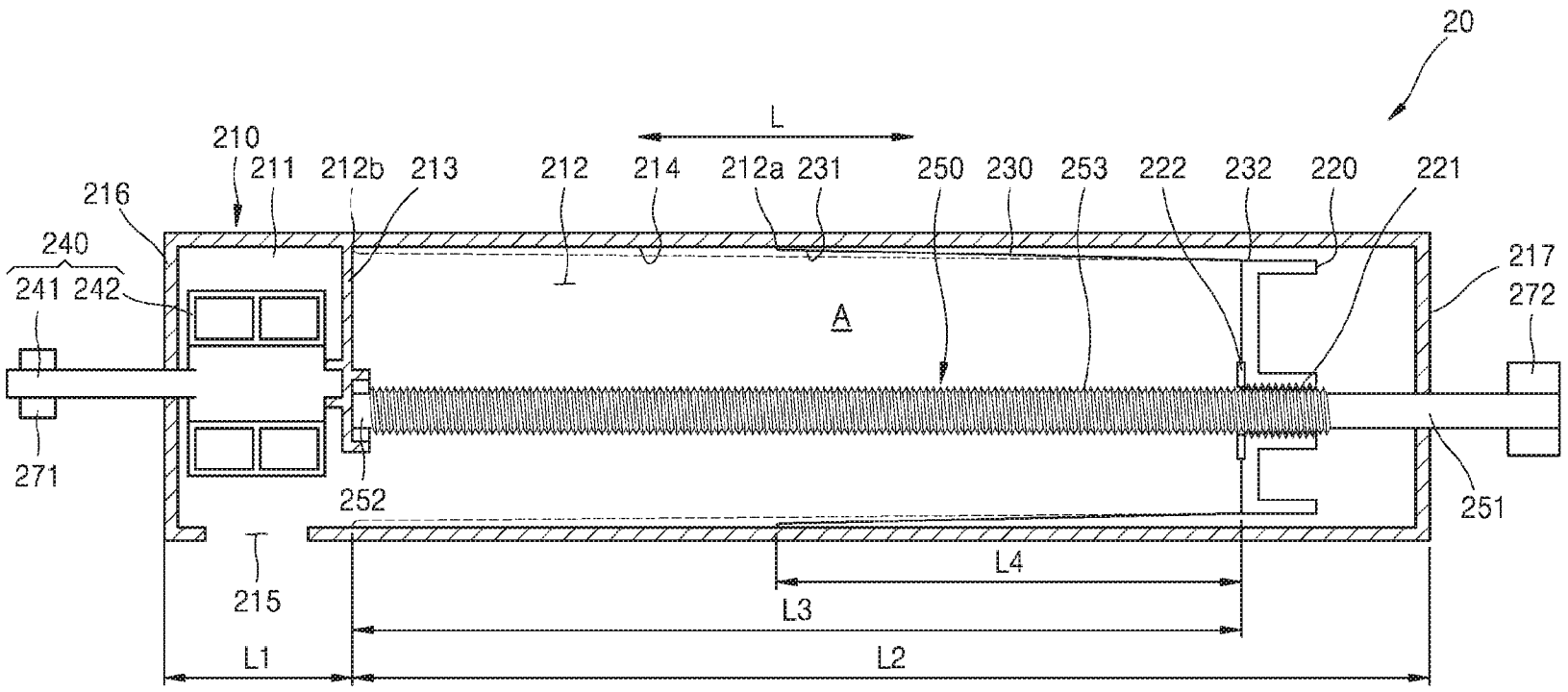
FIG. 3 is a cross-sectional view of a developer cartridge according to an embodiment.

FIG. 3 is a cross-sectional view of the developer cartridge 20 according to an embodiment. Referring to FIG. 3, the developer cartridge 20 may include a housing 210, a movable member 220, and a containing member 230.

The housing 210 includes a developer discharger 211 and a container 212. The container 212 extends from the developer discharger 211. For example, the container 212 extends from the developer discharger 211 in a length direction L of the housing 210. A length L1 of the developer discharger 211 may be less than a length L2 of the container 212. The housing 210 may include a barrier 213 for dividing the developer discharger 211 and the container 212 from each other. The barrier 213 partially separates the developer discharger 211 and the container 212 from each other. The expression 'partially separate' refers to the barrier 213 separating the developer discharger 211 and the container 212 from each other in such a manner that a developer is movable from the container 212 to the developer discharger 211. For example, there may be at least one opening (not shown) for interconnecting the container 212 and the developer discharger 211 between the barrier 213 and a wall 214 of the housing 210, or at least one opening (not shown) for interconnecting the container 212 and the developer discharger 211 may be provided in the barrier 213. The barrier 213 may support a stirring member 240 and a driving shaft 250 to be described below.

A developer outlet 215 is provided in the developer discharger 211. The developer is supplied through the developer outlet 215 to the developing unit 10. The supply tube 40 (see FIG. 1) may be connected to the developer outlet 215. Alternatively, the developer outlet 215 may be directly connected to the developing unit 10 as illustrated in FIG. 2. The stirring member 240 is mounted in the developer discharger 211. The stirring member 240 may be configured as a paddle capable of stirring the developer in the developer discharger 211 and carrying the same to the developer outlet 215. For instance, the stirring member 240 may include a rotation shaft 241 and stirring wings 242 extending outward from the rotation shaft 241. For example, the rotation shaft 241 may be supported by the barrier 213 and a side wall 216 of the housing 210 in the length direction L. A power transmission member 271 is provided on the rotation shaft 241. The power transmission member 271 may be, for example, a gear or a coupler. The power transmission member 271 may be connected to a motor (not shown) provided in the body 1. Alternatively, the power transmission member 271 may be connected to a motor (not shown) provided in the developer cartridge 20.

The movable member 220 is located in the container 212. The movable member 220 may move in a direction of changing the volume of the container 212. The moving direction of the movable member 220 may be, for example, the length direction L of the housing 210. The moving direction of the movable member 220 may be a direction toward the developer discharger 211, or a direction toward/away from the developer discharger 211. The movable member 220 is spaced apart from the wall 214 of the housing 210 (or the container 212). Accordingly, because the movable member 220 does not rub against the housing 210 while moving, a load of moving the movable member 220 may be reduced.

The movable member 220 may be supported by the driving shaft 250 and move in the length direction L. The driving shaft 250 extends in the length direction L and is rotatably supported by the housing 210. For example, an end 251 of the driving shaft 250 may be supported by a side wall 217 of the housing 210 in the length direction L opposite to the developer discharger 211, and the other end 252 thereof may be supported by the barrier 213. A helical part (or screw part or male screw part) 253 may be provided on the driving shaft 250. An engagement part 221 to be engaged with the helical part 253 may be provided on the movable member 220. The engagement part 221 may have a helical structure like the helical part 253, or a protrusion structure to be locked into at least one valley of the helical part 253. The engagement part 221 may be provided directly on the movable member 220. Alternatively, an additional member having the engagement part 221 may be coupled to the movable member 220. For example, a nut (not shown) having the engagement part 221 of a helical structure may be coupled to the movable member 220.

A power transmission member 272, e.g., a gear or a coupler, may be provided on the driving shaft 250. The power transmission member 272 may be connected to a motor (not shown) provided in the body 1. Alternatively, the power transmission member 272 may be connected to a motor (not shown) provided in the developer cartridge 20. Due to the above-described configuration, when the driving shaft 250 rotates, the movable member 220 may move in the length direction L.

A sealing member 222 prevents the developer from being leaked through a gap between the helical part 253 and the engagement part 221. In addition, the sealing member 222 wipes the developer adhered to the surface of the helical part 253, and thus prevents the developer from being caught between the helical part 253 and the engagement part 221. As such, a load applied to the driving shaft 250 may be reduced. The sealing member 222 may be mounted on, for example, the movable member 220. The sealing member 222 may be made of an elastic material, e.g., sponge or rubber.

The containing member 230 may be configured in a flexible bag shape having at least one open end 231. The end 231 of the containing member 230 is connected to a wall of the container 212 (e.g., the wall 214 of the housing 210), and the other end 232 thereof is connected to the movable member 220. The end 231 of the containing member 230, which is connected to the container 212, is open. Accordingly, the containing member 230 configures a developer containing space A together with the container 212. The other end 232 of the containing member 230 may be open. When the other end 232 is open, the other end 232 may be connected to the movable member 220 and thus the containing member 230 is configured as a bag, the end 231 of which is open. The containing member 230 may be configured as a bag, the end 231 of which is open and the other end 232 of which is closed.

The containing member 230 is made of a flexible material. The containing member 230 may be made of, for example, a polyethylene (PE) sheet, a low density polyethylene (LDPE) sheet, or a polyamide (PA) sheet. The containing member 230 may have a thickness equal to or less than, for example, 0.1 mm in such a manner that the containing member 230 may be flexibly folded, pleated, or turned inside out based on motion of the movable member 220 as will be described below. However, the thickness of the containing member 230 is not limited to any particular value as long as the containing member 230 may be folded, pleated, or turned inside out. Depending on the structure of the containing member 230, the containing member 230 may not be folded, pleated, or turned inside out. In this case, the thickness of the containing member 230 may be less than 0.1 mm.

The end 231 of the containing member 230 may be connected to a center part 212*a* of the container 212, or to an end 212*b* of the container 212 close to the developer discharger 211. The center part 212*a* does not refer to exactly the center of the length direction L of the container 212, but includes a part near the center. An effective length L4 of the containing member 230 may be equal to or greater than ½ of a stroke L3 of the movable member 220. Based on the length of the containing member 230, the end 231 of the containing member 230 may be connected to an appropriate location between the center part 212*a* and the end 212*b* of the container 212.

Figure 4A:
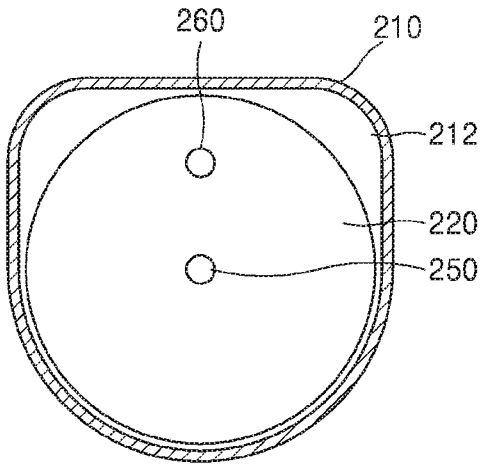
FIGS. 4A, 4B, 4C, 4D, 4E, 4F, and 4G are cross-sectional views of the developer cartridge, according to embodiments.
Figure 4B:
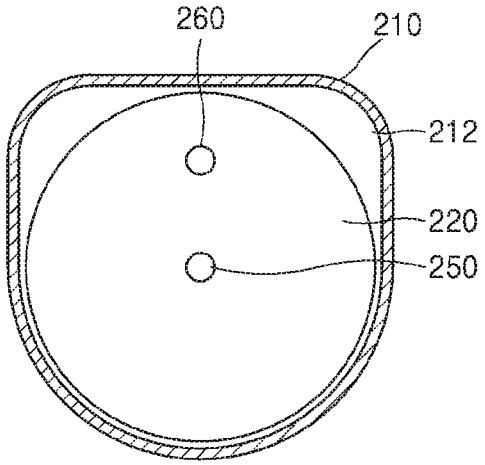
Figure 4C:
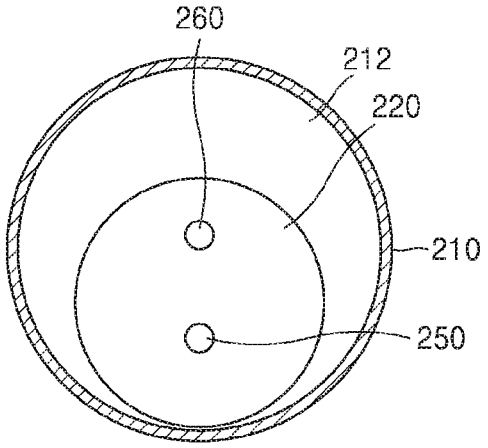
Figure 4D:
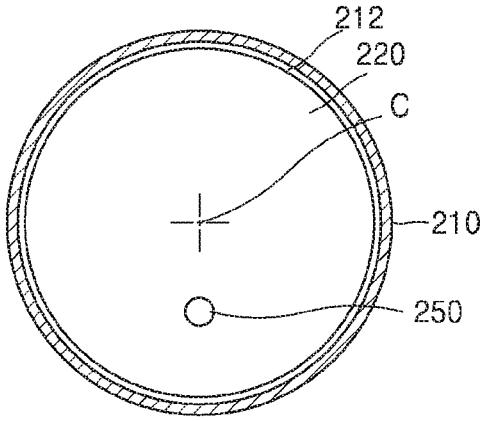
Figure 4E:
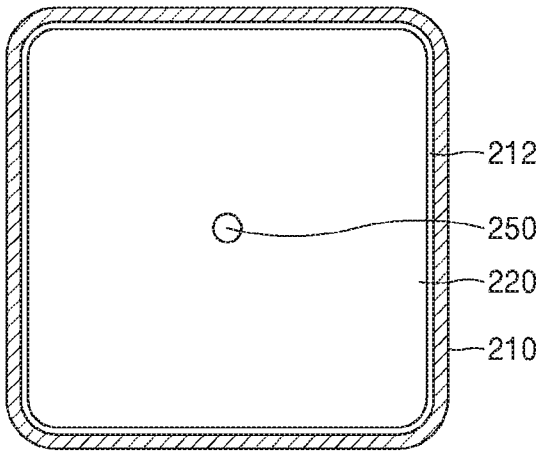
Figure 4F:
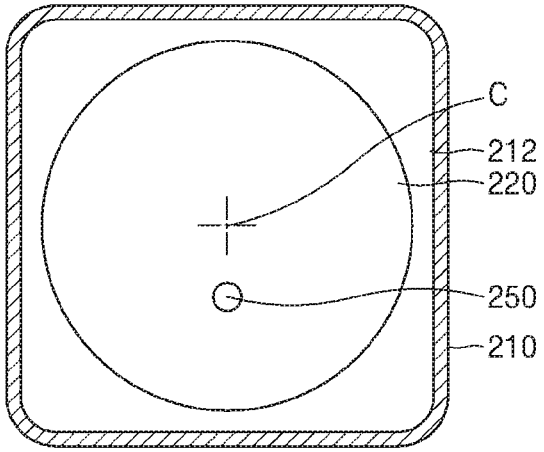
Figure 4G:
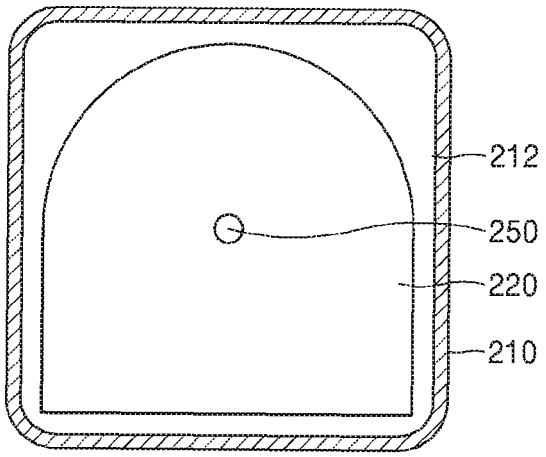

FIGS. 4A, 4B, 4C, 4D, 4E, 4F, and 4G are cross-sectional views of the developer cartridge 20, according to embodiments. A cross-sectional shape of the container 212 is not limited to any particular shape as illustrated in FIGS. 4A to 4G. A cross-sectional shape of the movable member 220 may be the same as or different from the cross-sectional shape of the container 212. When the driving shaft 250 rotates, the movable member 220 moves in the length direction L. As illustrated in FIGS. 4A, 4B, 4C, 4D, and 4F, if the movable member 220 has a cross-sectional shape which is rotatable in the container 212, when the driving shaft 250 rotates, the movable member 220 may also rotate. To prevent this problem, as illustrated in FIGS. 4A, 4B, and 4C, the movable member 220 may be guided by a guide member 260 extending in the length direction L of the housing 210. The guide member 260 simultaneously serves as a guide member for guiding the movable member 220 to stably move in the length direction L, and a rotation prevention member for preventing rotation of the movable member 220. The guide member 260 may extend, for example, from the side wall 217 of the housing 210 to the barrier 213. To prevent rotation of the movable member 220, as illustrated in FIGS. 4D and 4F, the driving shaft 250 may be located at a location deviating from a geometric center C of the movable member 220. As illustrated in FIGS. 4E and 4G, the movable member 220 may have a cross-sectional shape which is not rotatable in the container 212. In this case, the location of the driving shaft 250 is not limited to any particular location.

Figure 5A:
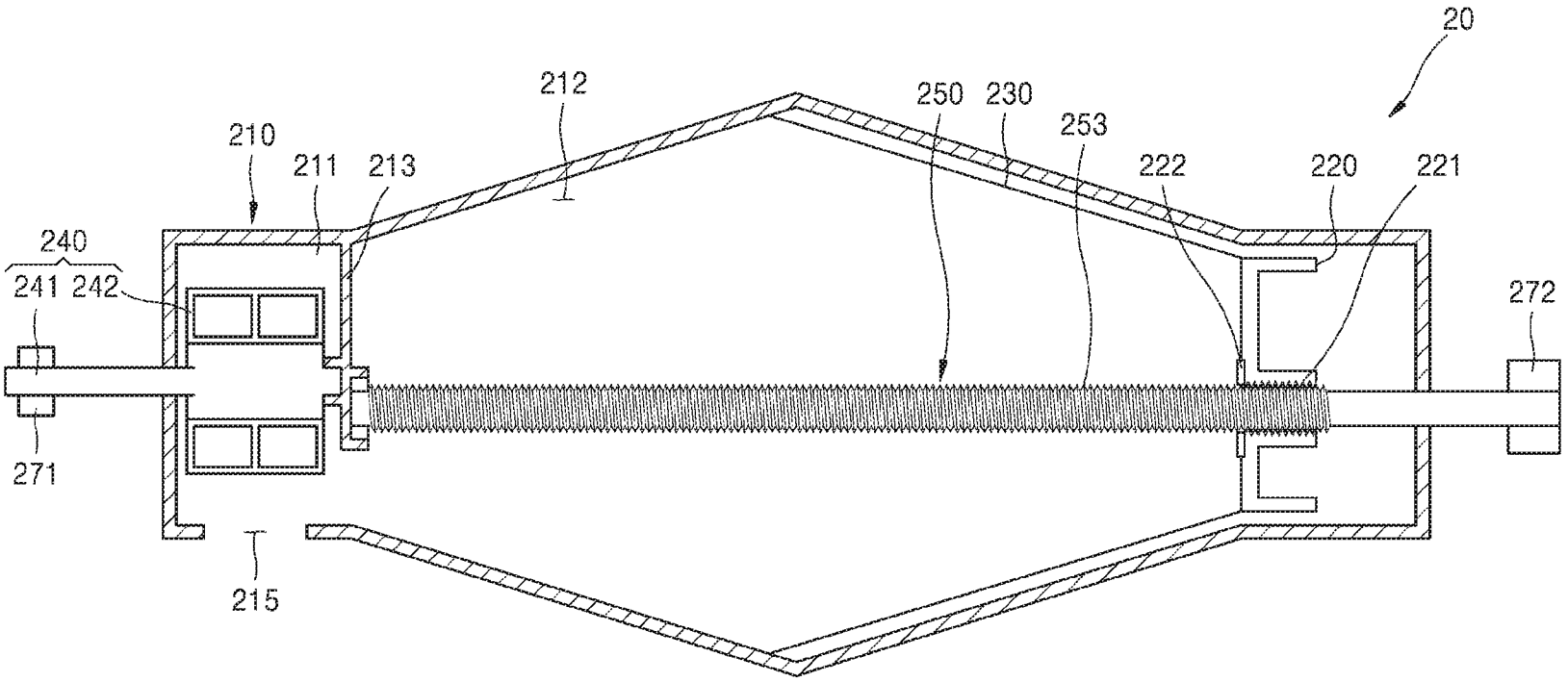
FIGS. 5A and 5B are length-direction cross-sectional views of the developer cartridge, according to other embodiments.
Figure 5B:
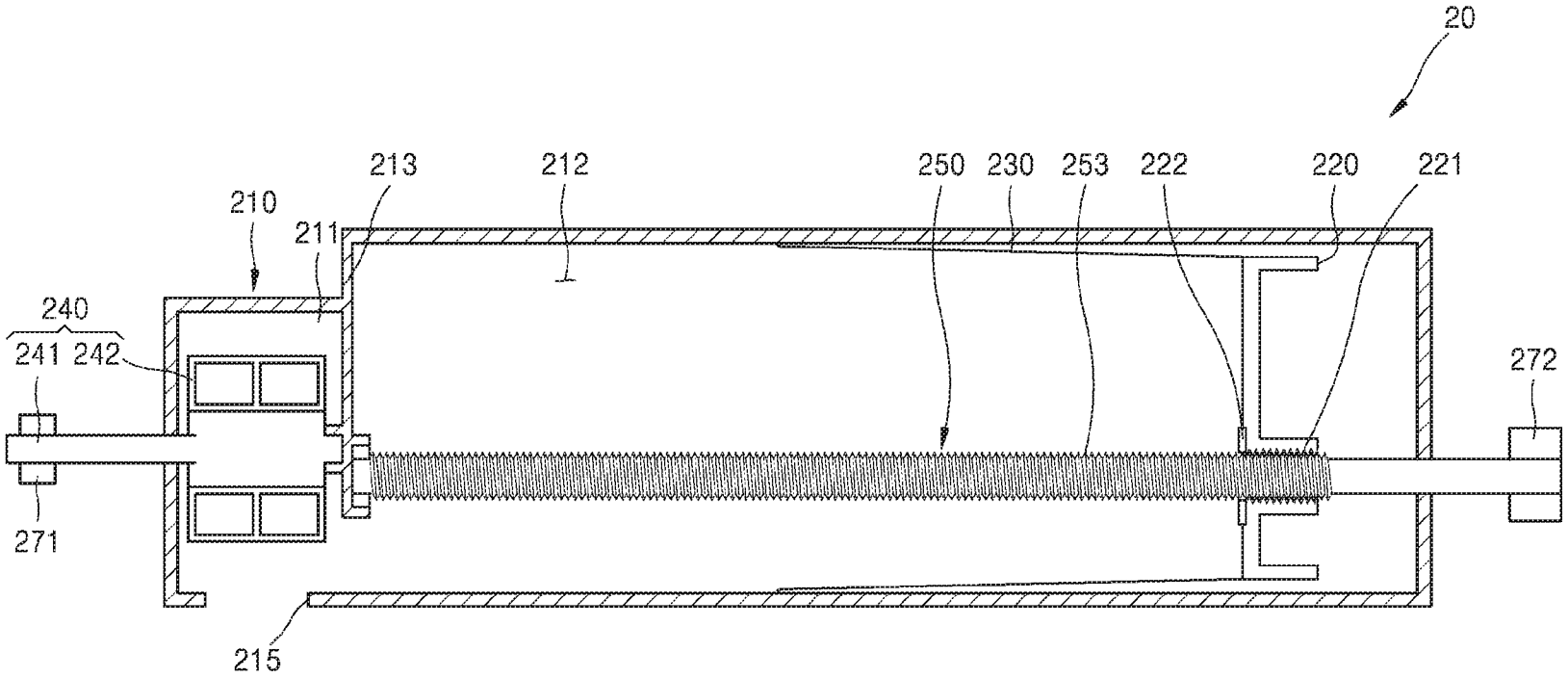

The cross-sectional shape of the container 212 may be maintained constant along the length direction L. Alternatively, the cross-sectional shape of the container 212 may not be maintained constant as illustrated in FIG. 5A. Otherwise, the developer discharger 211 and the container 212 may have different levels as illustrated in FIG. 5B.

Figure 6A:
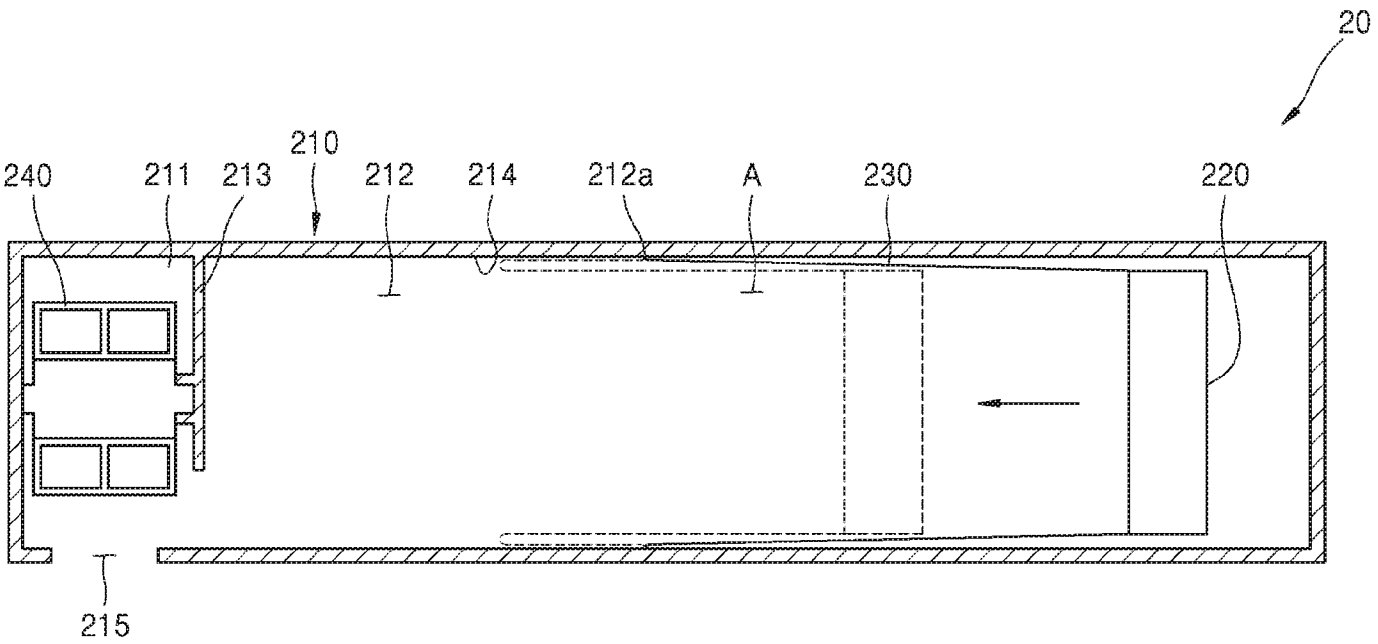
FIGS. 6A, 6B, and 6C are cross-sectional views showing changes in a containing member based on motion of a movable member.
Figure 6B:
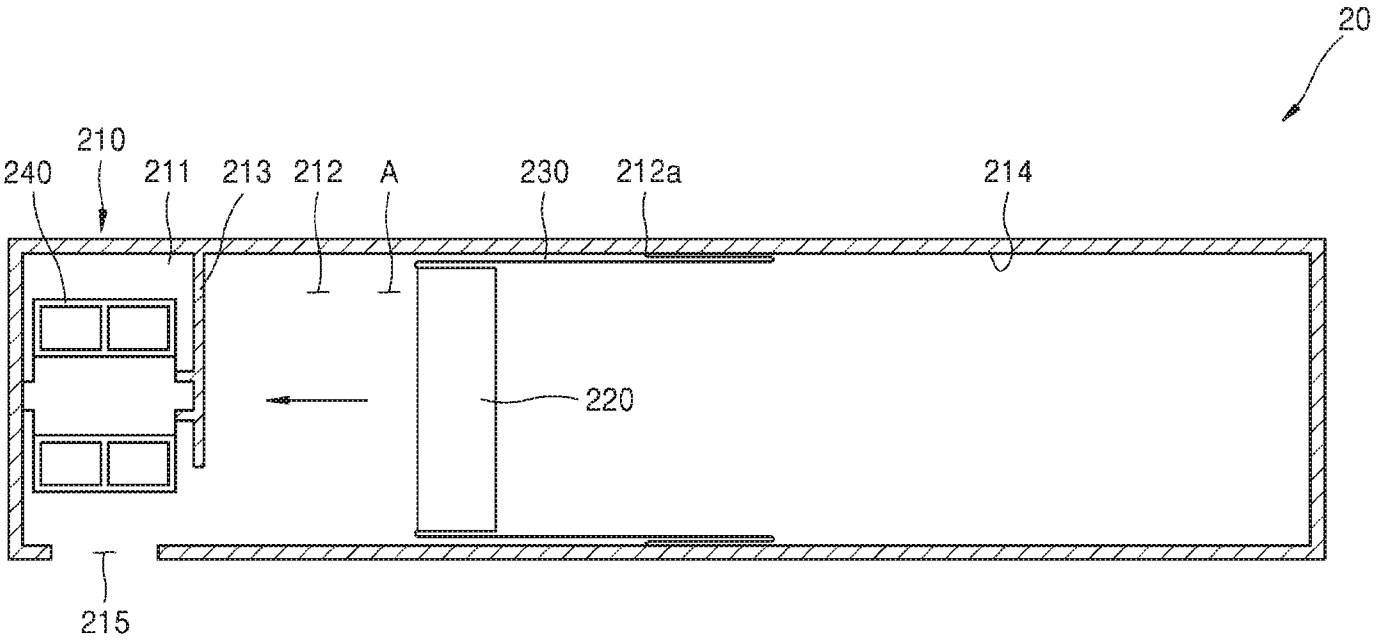
Figure 6C:
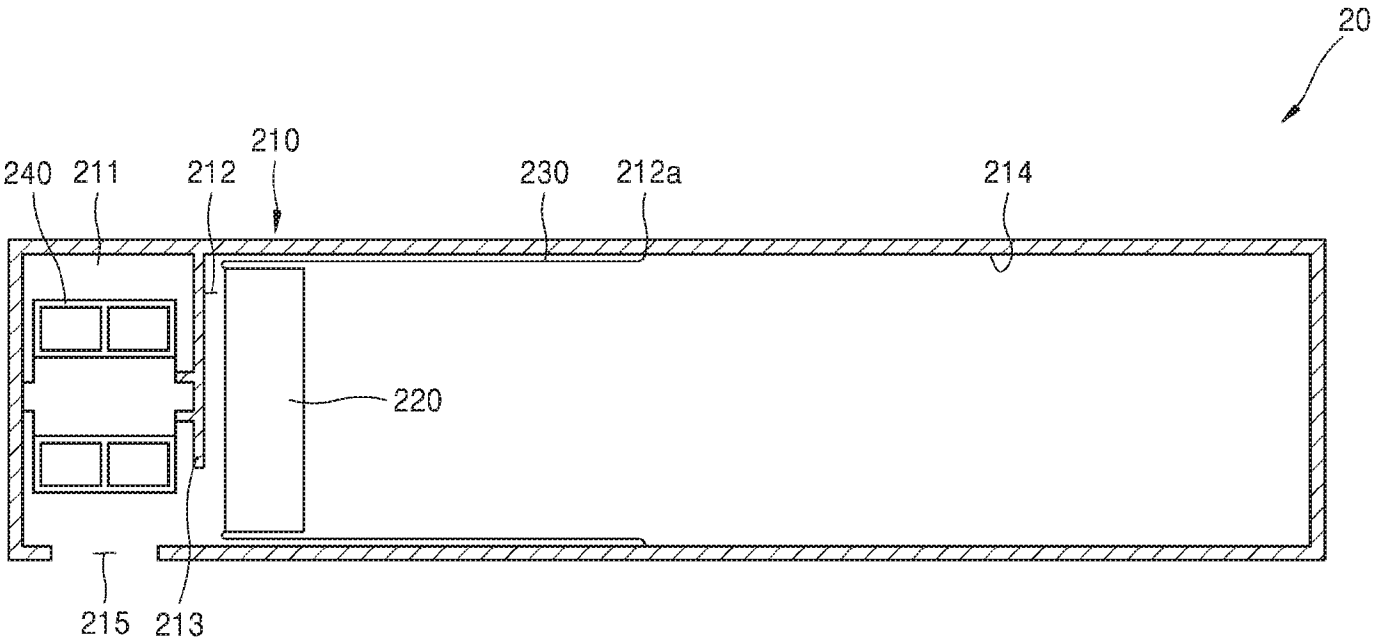

FIGS. 6A, 6B, and 6C are cross-sectional views showing changes in the containing member 230 based on motion of the movable member 220. FIGS. 6A, 6B, and 6C do not illustrate the driving shaft 250 but schematically illustrate the developer cartridge 20 to show changes in the containing member 230 based on the location of the movable member 220. Operation of the developer cartridge 20 will now be described with reference to FIGS. 6A, 6B, and 6C.

Initially, referring to FIG. 6A, the movable member 220 is located at an initial location. The initial location is a location close to the side wall 217 of the housing 210. A developer is contained in the developer containing space A configured by the container 212 and the containing member 230. When the driving shaft 250 rotates, the movable member 220 moves toward the developer discharger 211. Then, the volume of the developer containing space A is changed, and the developer is carried from the container 212 to the developer discharger 211. When the stirring member 240 rotates, the developer in the developer discharger 211 is discharged through the developer outlet 215 and is supplied to the developing unit 10.

When the movable member 220 moves toward the developer discharger 211, the flexible containing member 230 is folded as indicated by a dashed line in FIG. 6A. When the movable member 220 moves beyond the center part 212*a* of the container 212 as illustrated in FIG. 6B, the containing member 230 partially or totally passes through a gap between the movable member 220 and the wall 214 of the container 212 to the back of the movable member 220. When the movable member 220 moves toward the developer discharger 211, the volume of the developer containing space A is gradually reduced and the developer is carried toward the developer discharger 211.

As illustrated in FIG. 6C, the movable member 220 may move to a location very close to the barrier 213. When the movable member 220 is close to the barrier 213, the developer contained in the developer cartridge 20 is almost completely consumed.

As described above, the stirring member 240 is mounted in the developer discharger 211 and stirs only the developer inside the developer discharger 211. The length L1 of the developer discharger 211 is less than the length L2 of the container 212. Therefore, compared to an existing developer cartridge including a stirring member extending over the whole internal space of the developer cartridge 20 (the developer discharger 211 and the container 212), a load of driving the stirring member 240 may be reduced. In addition, because the movable member 220 is spaced apart from the wall 214 of the housing 210, a load of moving the movable member 220 is small. Accordingly, a load of driving the driving shaft 250 may be reduced.

Because only the developer inside the developer discharger 211 is stirred and the developer inside the container 212 is not stirred, a total amount of stirring stress applied to the developer contained in the developer cartridge 20 (e.g., a total stirring time) may be reduced and thus developer stress may also be reduced. Accordingly, properties of the developer may be stably maintained for the lifetime of the developer cartridge 20, and thus printed images having stable quality may be obtained.

Figure 7A:
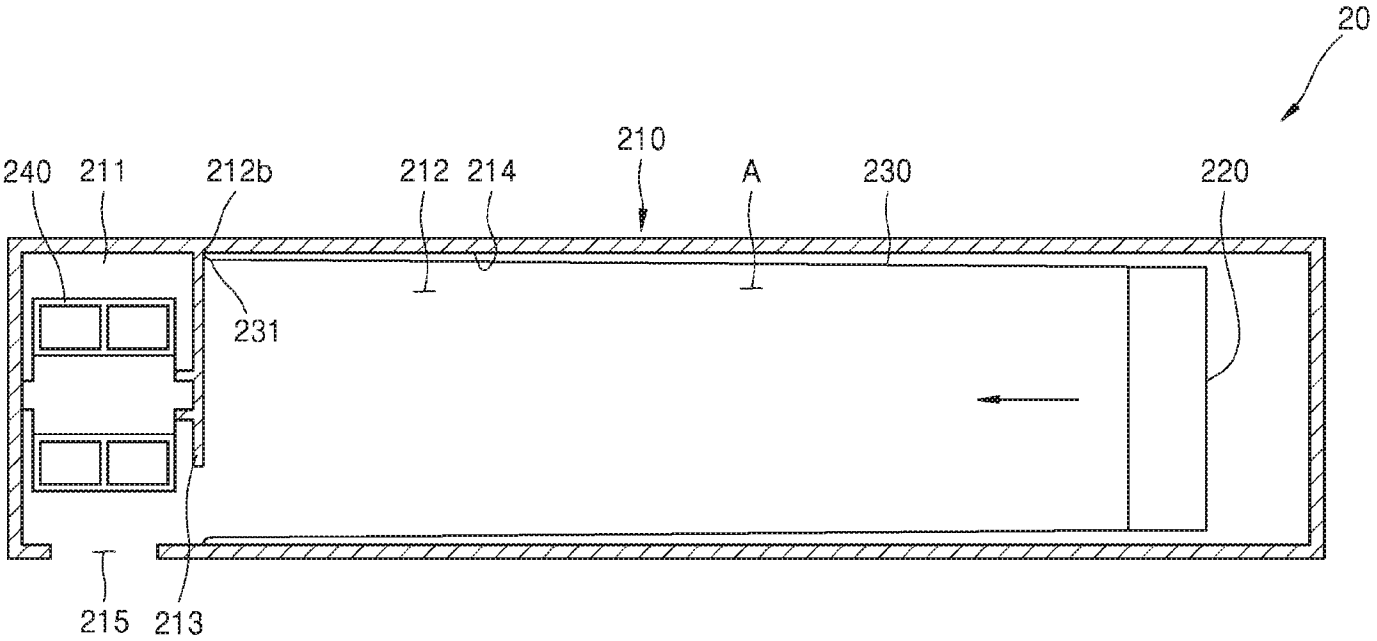
FIGS. 7A and 7B are cross-sectional views of the developer cartridge according to an embodiment.
Figure 7B:
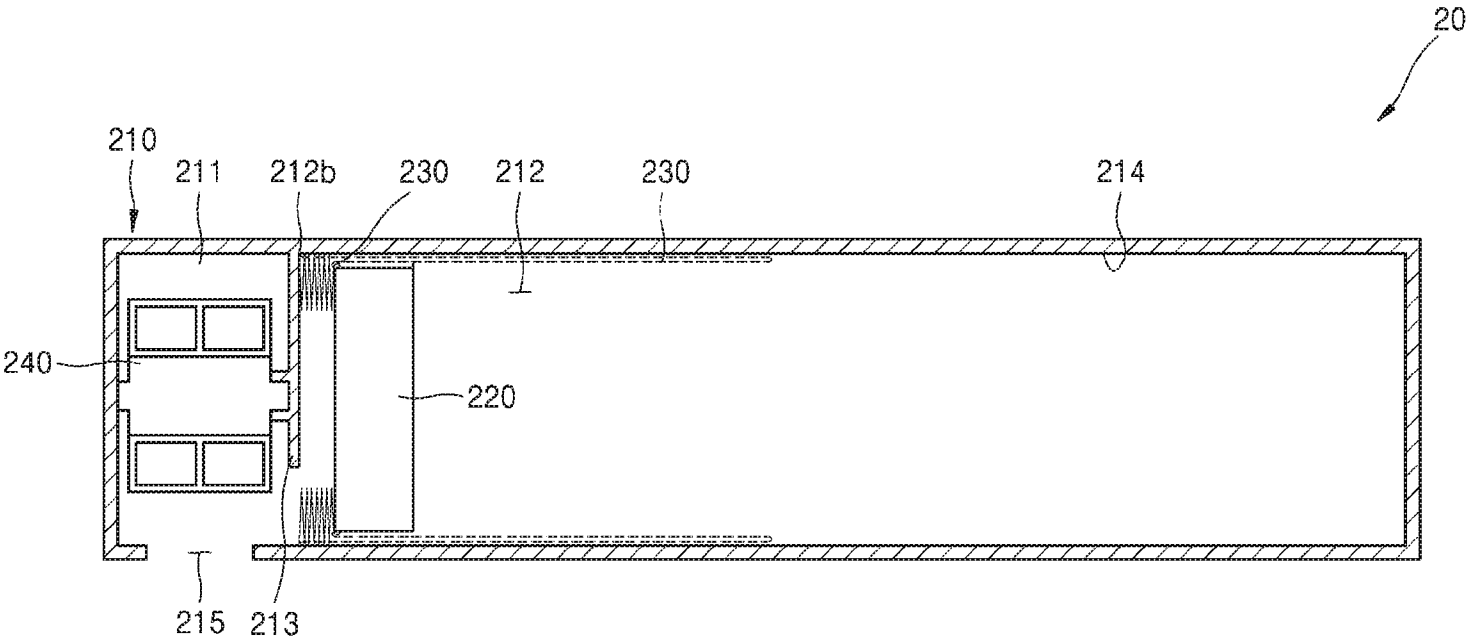

FIGS. 7A and 7B are cross-sectional views of the developer cartridge 20 according to an embodiment. FIGS. 7A and 7B are characterized in a connection location of the containing member 230 and thus do not illustrate the driving shaft 250. Referring to FIG. 7A, the end 231 of the containing member 230 is connected to the end 212*b* of the container 212 close to the developer discharger 211. When the movable member 220 approaches the barrier 213, the containing member 230 may be pleated between the barrier 213 and the movable member 220 as indicated by a solid line in FIG. 7B, and or may pass through a gap between the movable member 220 and the wall 214 of the container 212 so as to be folded behind the movable member 220 as indicated by a dashed line in FIG. 7B.

Figure 8A:
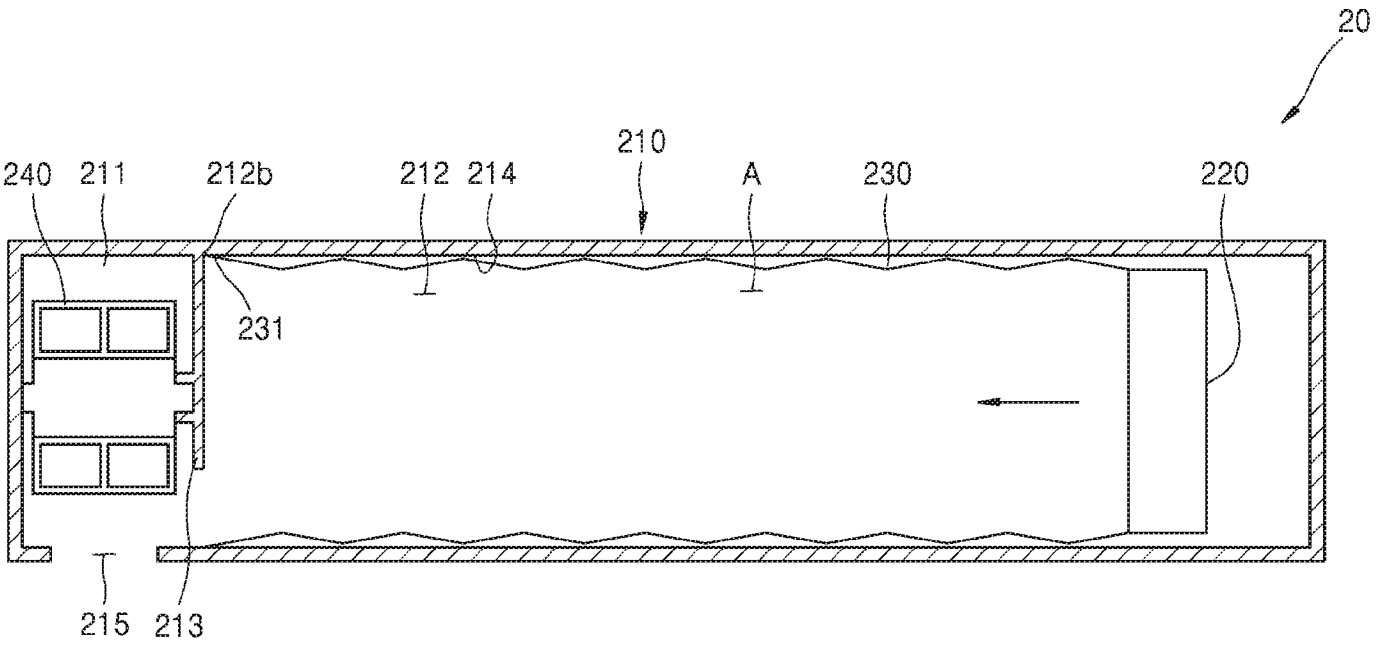
FIGS. 8A and 8B are cross-sectional views of the developer cartridge according to an embodiment.
Figure 8B:
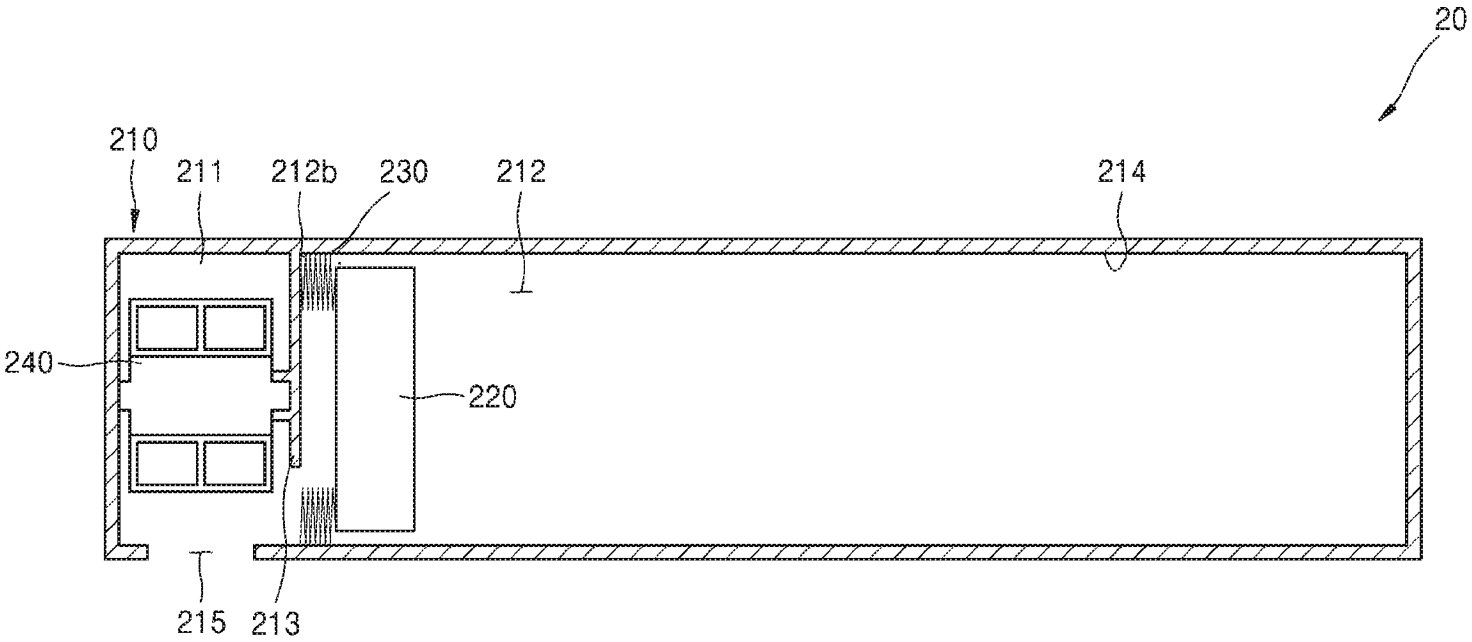

FIGS. 8A and 8B are cross-sectional views of the developer cartridge 20 according to an embodiment. FIGS. 8A and 8B are characterized in a shape of the containing member 230 and thus do not illustrate the driving shaft 250. Referring to FIG. 8A, the end 231 of the containing member 230 is connected to the end 212*b* of the container 212 close to the developer discharger 211. The containing member 230 is configured as a pleated bag. When the movable member 220 approaches the barrier 213, the containing member 230 is pleated between the barrier 213 and the movable member 220, as illustrated in FIG. 8B.

Figure 9A:
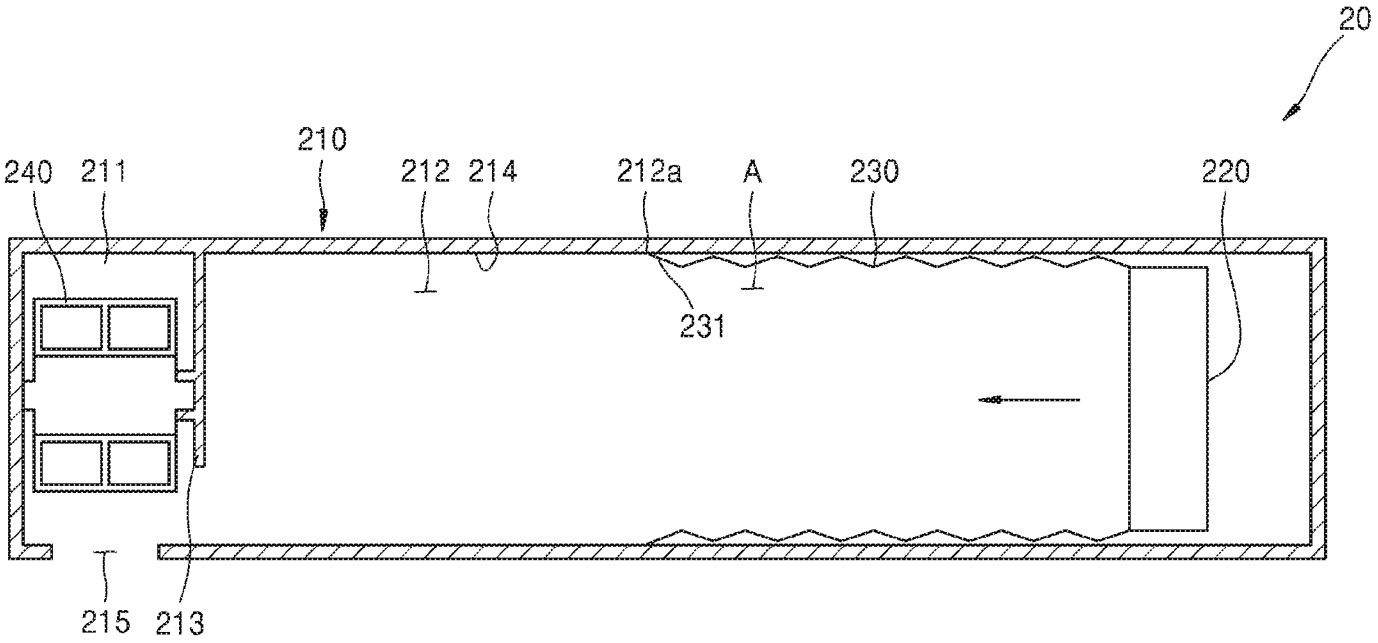
FIGS. 9A and 9B are cross-sectional views of the developer cartridge according to an embodiment.
Figure 9B:
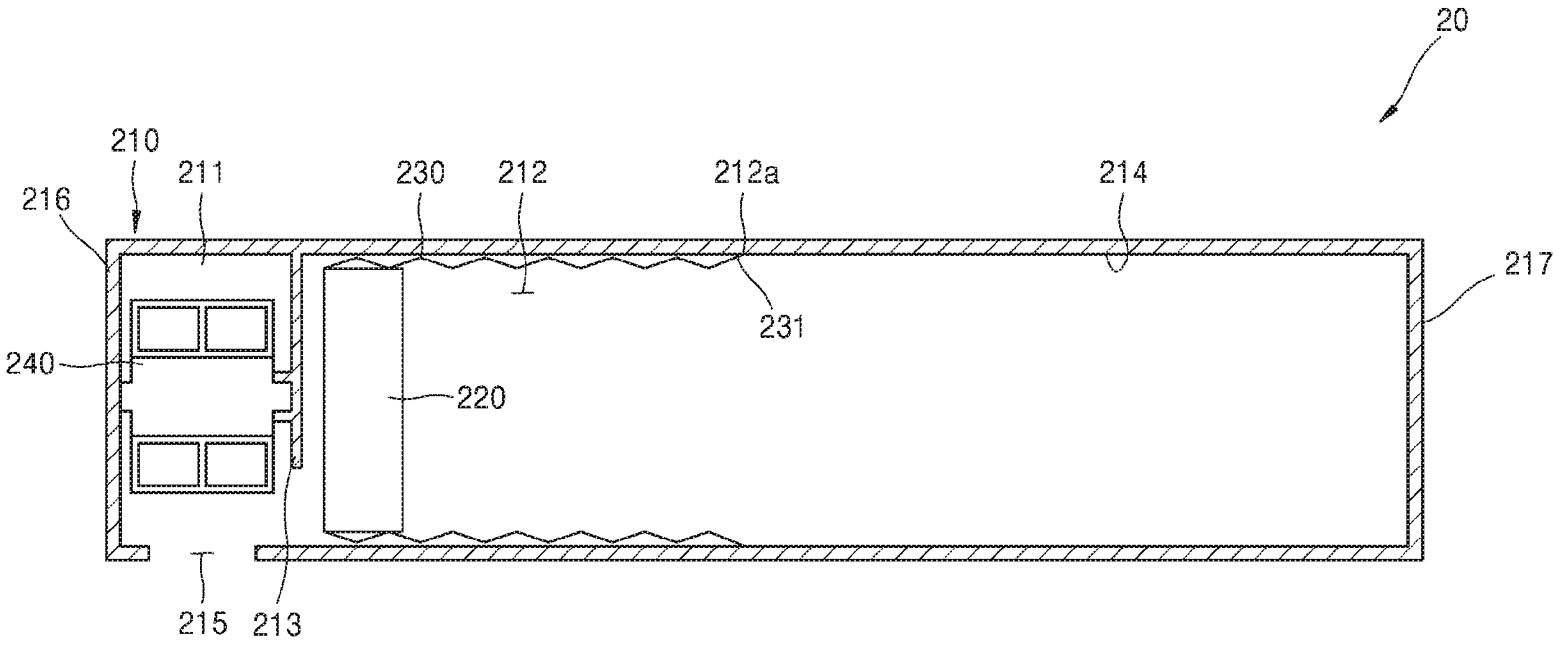

FIGS. 9A and 9B are cross-sectional views of the developer cartridge 20 according to an embodiment. FIGS. 9A and 9B are characterized in a shape and a connection location of the containing member 230 and thus do not illustrate the driving shaft 250. Referring to FIG. 9A, the end 231 of the containing member 230 is connected to the center part 212*a* of the container 212. The containing member 230 is configured as a pleated bag. When the movable member 220 moves toward the center part 212*a*, the containing member 230 is pleated. When the movable member 220 passes the center part 212*a*, the containing member 230 passes through a gap between the movable member 220 and the wall 214 so as to be turned inside out behind the movable member 220, as illustrated in FIG. 9B. Because the movable member 220 may move closer to the developer discharger 211 compared to the embodiment of FIGS. 8A and 8B, a ratio of a total amount of a developer contained in the developer cartridge 20 to the amount of the developer effectively supplied to the developing unit 10 (developer usability) may be increased. In addition, the developer adhered to an internal wall of the containing member 230 is separated from the internal wall due to vibration generated when the containing member 230 configured as a pleated bag is turned inside out. Accordingly, developer usability may be further increased.

Figure 10:
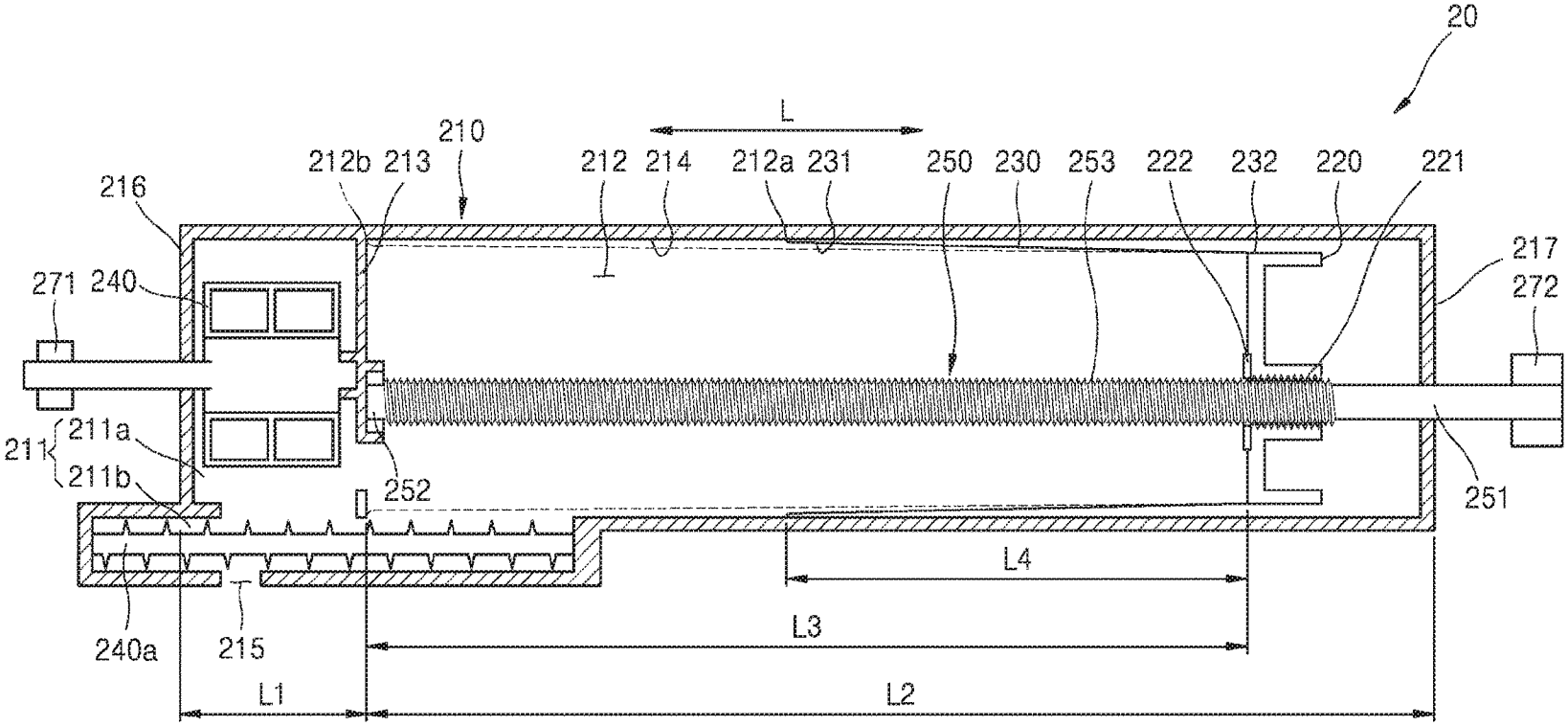
FIG. 10 is a cross-sectional view of the developer cartridge according to an embodiment.

FIG. 10 is a cross-sectional view of the developer cartridge 20 according to an embodiment. The developer cartridge 20 of FIG. 10 differs from the developer cartridge 20 of FIG. 3 in that the developer cartridge 20 further includes a second stirring member 240*a*. The developer discharger 211 includes a first discharger 211*a* having mounted the stirring member 240 therein, and a second discharger 211*b* connected to the first discharger 211*a* and having mounted the second stirring member 240*a* therein. The second discharger 211*b* is provided in parallel with the first discharger 211*a*. The second stirring member 240*a* is provided in parallel with the stirring member 240, and carries a developer inside the second discharger 211*b* in the length direction L. For example, the second stirring member 240*a* may include an auger extending in the length direction L. The developer outlet 215 is provided in the second discharger 211*b*. The second stirring member 240*a* carries the developer inside the second discharger 211*b* to the developer outlet 215. By controlling the speed of rotation and the number of rotations of, and whether to rotate the second stirring member 240*a*, the developer may be supplied from the developer cartridge 20 to the developing unit 10 at a desired time by a desired amount.

The second discharger 211*b* may be located under the container 212 in the direction of gravity, and may extend beyond the barrier 213 toward the container 212 so as to be connected to the container 212. The second stirring member 240*a* may also extend beyond the barrier 213 toward the container 212. The first discharger 211*a* may be aligned with the container 212, and the second discharger 211*b* may be located in parallel with the container 212 under the container 212 in the direction of gravity. Due to the above-described configuration, the developer not carried to the first discharger 211*a* but remaining between the barrier 213 and the movable member 220 when the movable member 220 approaches the barrier 213 may fall into the second discharger 211*b* and may be carried to the developer outlet 215 by the second stirring member 240*a*. Accordingly, a residual developer may be reduced and thus developer usability may be increased.

The second discharger 211*b* and the second stirring member 240*a* illustrated in FIG. 10 may be equally applicable to the embodiments of the developer cartridge 20 illustrated in FIGS. 4A to 4G, 7A, 7B, 8A, 8B, 9A, and 9B.

Figure 11:
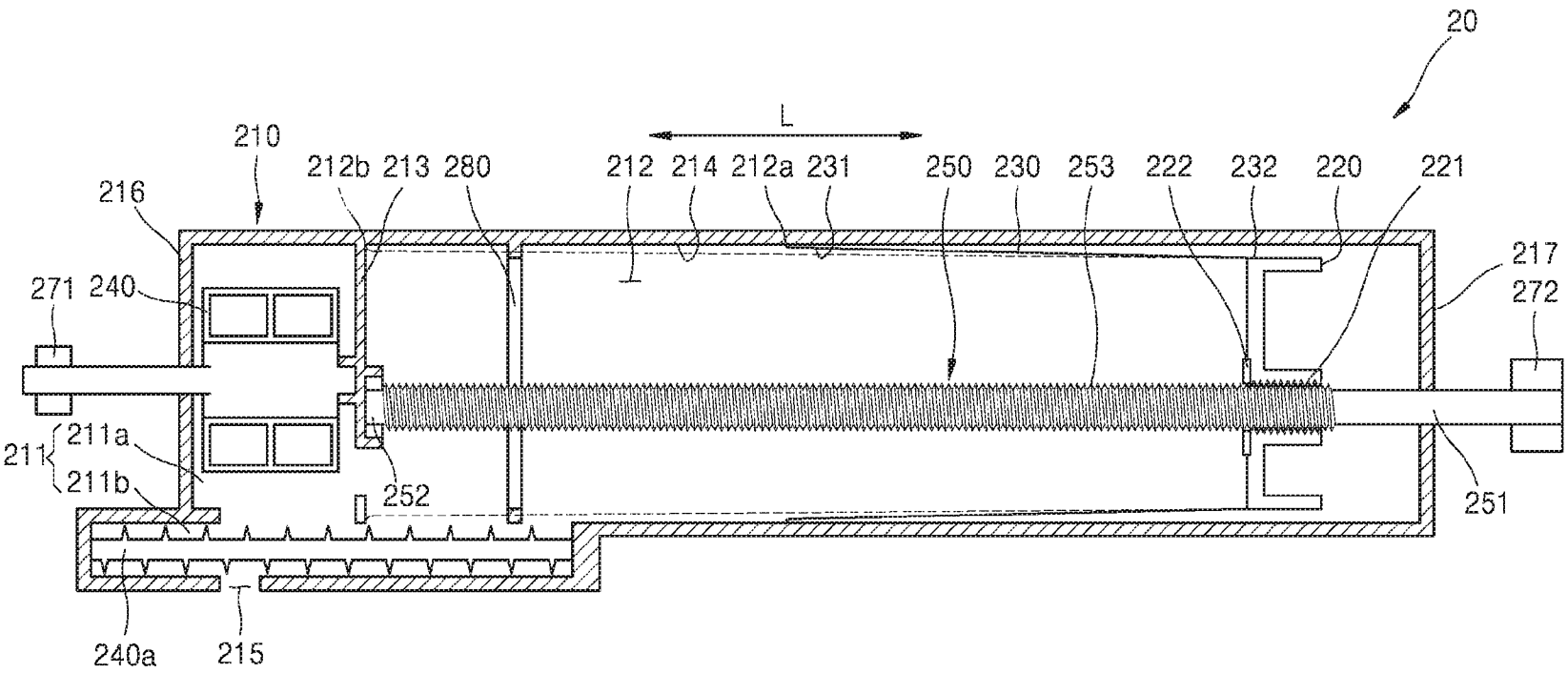
FIG. 11 is a cross-sectional view of the developer cartridge according to an embodiment.

FIG. 11 is a cross-sectional view of the developer cartridge 20 according to an embodiment. The developer cartridge 20 of FIG. 11 differs from the developer cartridge 20 of FIG. 10 in that the developer cartridge 20 further includes a scraper 280. The scraper 280 may, for example, protrude inward from the wall 214 of the container 212. The scraper 280 may have, for example, a ring shape, and protrusions may be partially provided in a circumferential direction of the ring shape. The scraper 280 may be located, for example, close to the center part 212*a*. If the end 231 of the containing member 230 is connected to the center part 212*a*, when the movable member 220 moves beyond the center part 212*a*, the containing member 230 is turned inside out. The scraper 280 scrapes a developer from an internal surface of the containing member 230 which is turned inside out. The developer separated from the internal surface of the containing member 230 may be effectively carried to the developer discharger 211. In the embodiment of FIG. 11, the scraper 280 is located between the end 212*b* of the container 212 close to the developer discharger 211 and an end of the second discharger 211*b* close to the container 212. According to the above-described structure, the developer separated from the internal surface of the containing member 230 may directly fall into the second discharger 211*b* and may be carried to the developer outlet 215 by the second stirring member 240*a*. Accordingly, developer usability may be increased.

The scraper 280 may be equally applicable to the embodiments of FIGS. 3, 4A to 4G, 7A, 7B, 8A, 8B, 9A, and 9B. If the end 231 of the containing member 230 is connected to the end 212*b* of the container 212, because the scraper 280 contacts the containing member 230 as the movable member 220 moves, the scraper 280 may vibrate the containing member 230 to separate the developer from the internal surface of the containing member 230. Particularly, when the containing member 230 is configured as a pleated bag, because the containing member 230 more effectively vibrates in contact with the scraper 280, the developer adhered to the internal surface of the containing member 230 may be more easily separated therefrom. Accordingly, developer usability may be increased by employing the scraper 280 contacting the containing member 230.

Although FIG. 3 illustrates a driving structure in which the power transmission members 271 and 272 are coupled to the stirring member 240 and the driving shaft 250, respectively, the stirring member 240 and the driving shaft 250 may be driven using a variety of structures.

Figure 12:
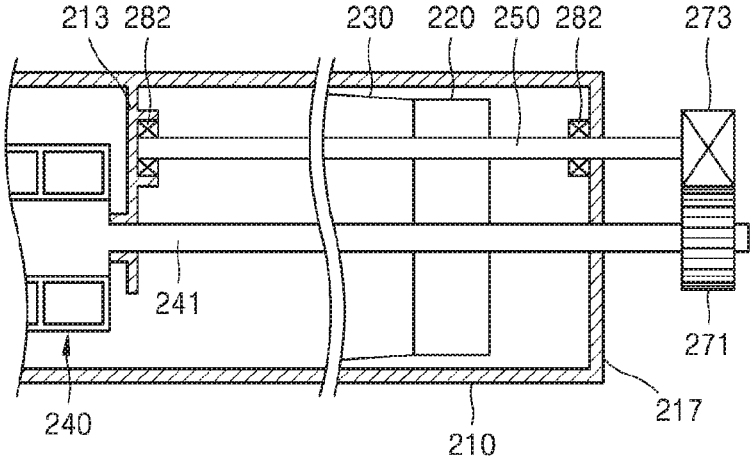
FIG. 12 is a cross-sectional view of a driving structure according to an embodiment.

FIG. 12 is a cross-sectional view of a driving structure according to an embodiment. FIG. 12 schematically illustrates the driving shaft 250 and the helical part 253 is omitted. Referring to FIG. 12, the rotation shaft 241 of the stirring member 240 penetrates through the container 212 and the movable member 220 and protrudes from the side wall 217. A protruding end of the rotation shaft 241 is connected to the power transmission member 271 (e.g., a gear 271). As described above, the gear 271 is driven by a motor provided in the body 1 or the developer cartridge 20. The driving shaft 250 is connected to the gear 271 by a power transmission member 273.

The power transmission member 273 may be, for example, an electromagnetic clutch capable of cutting off power based on an electrical signal. As such, to move the movable member 220, the electromagnetic clutch may be turned on to transmit rotatory power of the gear 271 to the driving shaft 250. According to the above-described structure, the movable member 220 may move forward or backward by rotating the gear 271 in a forward or reverse direction, and the stirring member 240 may continuously rotate while the movable member 220 is moving forward or backward.

The power transmission member 273 may be, for example, a one-way clutch. The one-way clutch transmits rotatory power of the gear 271 to the driving shaft 250 when the gear 271 rotates in a forward direction, and cuts off rotatory power of the gear 271 not to be transmitted to the driving shaft 250 when the gear 271 rotates in a reverse direction. The one-way clutch may have a variety of structures.

Figure 13:
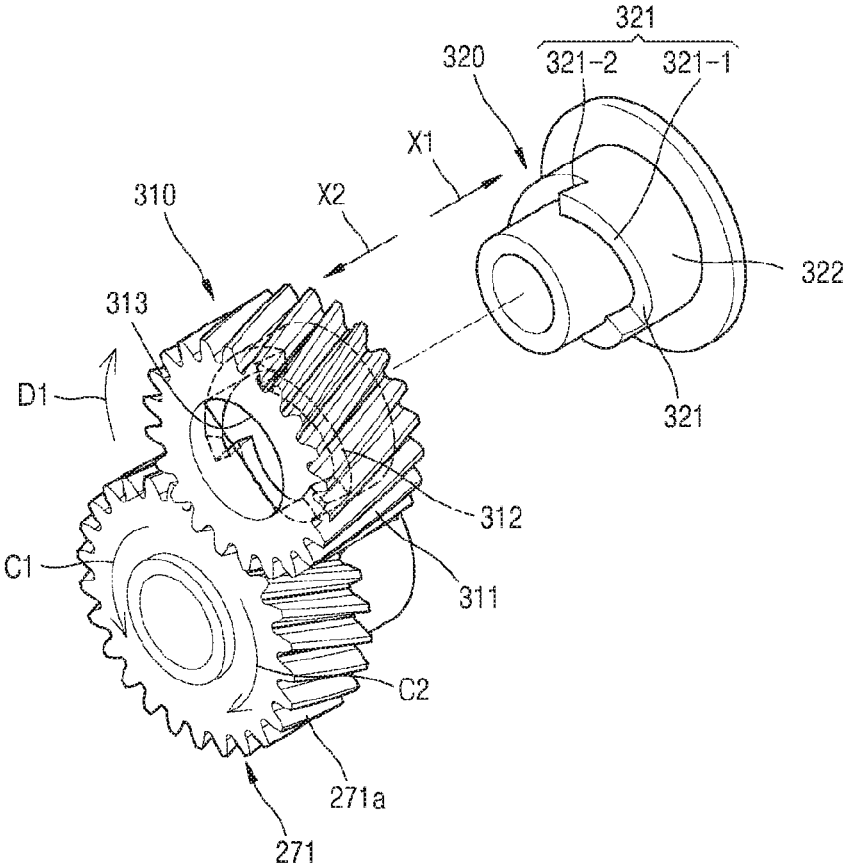
FIG. 13 is an exploded perspective view of a one-way clutch according to an embodiment.

FIG. 13 is an exploded perspective view of a one-way clutch according to an embodiment. Referring to FIG. 13, the one-way clutch includes a rotary member 310 connected to and rotated by the gear 271, and a transmission member 320 coupled to the driving shaft 250. The gear 271 includes a first gear 271*a* configured as a helical gear. The rotary member 310 includes a second gear 311 configured as a helical gear engaged with the first gear 271*a*. Helical directions of the first and second gears 271*a* and 311 may be determined in such a manner that the rotary member 310 moves in a direction X1 when the gear 271 rotates in a direction C1, and that thrust is generated to move the rotary member 310 in a direction X2 when the gear 271 rotates in a direction C2.

The rotary member 310 includes a first latch 312, and the transmission member 320 includes a second latch 321. The first and second latches 312 and 321 may have shapes capable of transmitting rotatory power of only one direction. That is, the first and second latches 312 and 321 may have shapes which are engaged with each other to transmit rotatory power to each other when rotating in a forward direction, and are disengaged from each other when rotating in a reverse direction. The first and second latches 312 and 321 have complementary convex and concave shapes which are engaged with each other when the rotary member 310 moves in the direction X1 and are disengaged from each other when the rotary member 310 moves in the direction X2. For example, as illustrated in FIG. 13, the second latch 321 may include an inclined surface 321-1 extending in a circumferential direction diagonally to an axial direction, and a counter surface 321-2 extending in a radius direction from the inclined surface 321-1. The first latch 312 may have a shape complementary to the second latch 321. The rotary member 310 may include an inner diameter part 313, and the first latch 312 may be provided on an internal wall of the inner diameter part 313. The transmission member 320 may include an outer diameter part 322, and the second latch 321 may be provided on an outer circumference of the outer diameter part 322. The second latch 321 is inserted into the inner diameter part 313. As such, rotatory power of the rotary member 310 may be transmitted to the transmission member 320 when the first and second latches 312 and 321 are engaged with each other, and is not transmitted to the transmission member 320 when the first and second latches 312 and 321 are disengaged from each other.

When the gear 271 rotates in the direction C1, the rotary member 310 moves in the direction X1 and thus the first and second latches 312 and 321 are engaged with each other. Rotatory power of the gear 271 in the direction C1 is transmitted via the transmission member 320 to the driving shaft 250. Accordingly, the driving shaft 250 rotates in a direction D1, and the movable member 220 moves, for example, toward the developer discharger 211. When the gear 271 rotates in the direction C2, thrust in the direction X2 is generated in the rotary member 310, the rotary member 310 moves in the direction X2, and thus the first and second latches 312 and 321 are disengaged from each other. Accordingly, rotatory power of the gear 271 in the direction C2 is not transmitted to the transmission member 320 and the driving shaft 250, and the driving shaft 250 does not rotate. The movable member 220 does not move. When the gear 271 rotates in the direction C1 or C2, the stirring member 240 also rotates in the direction C1 or C2.

Figure 14A:
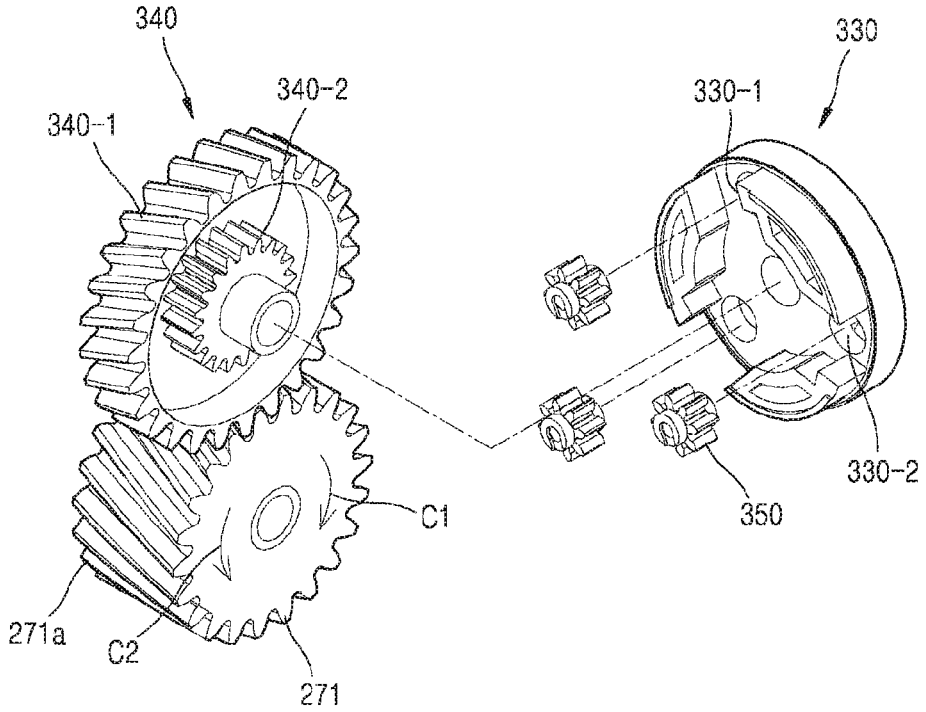
FIG. 14A is an exploded perspective view of a one-way clutch according to an embodiment.
Figure 14B:
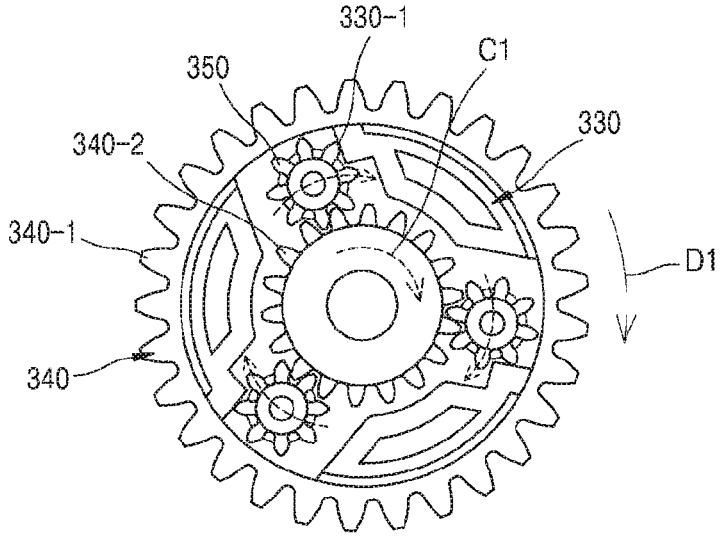
FIG. 14B shows that a gear of the one-way clutch illustrated in FIG. 14A rotates in a direction C1.
Figure 14C:
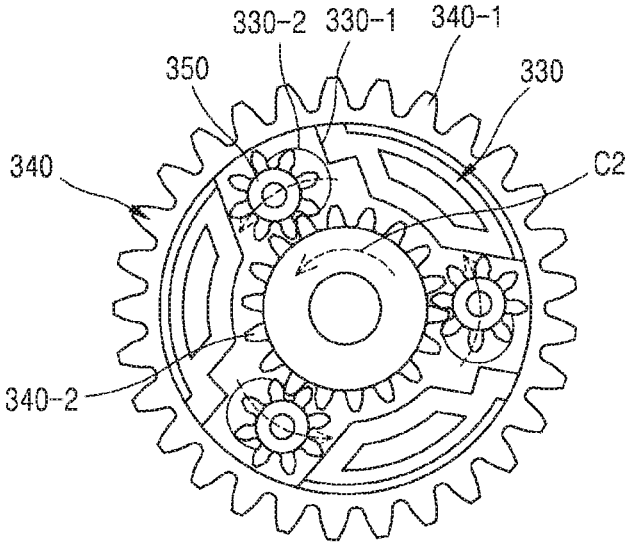
FIG. 14C shows that the gear of the one-way clutch illustrated in FIG. 14A rotates in a direction C2.

FIG. 14A is an exploded perspective view of a one-way clutch according to an embodiment. FIG. 14B shows that the gear 271 of the one-way clutch illustrated in FIG. 14A rotates in the direction C1. FIG. 14C shows that the gear 271 of the one-way clutch illustrated in FIG. 14A rotates in the direction C2.

Referring to FIG. 14A, the one-way clutch includes a first rotary member 330, a second rotary member 340, and latch gears 350. The first rotary member 330 is coupled to the driving shaft 250. The first rotary member 330 includes latches 330-1 and guides 330-2. The latch gears 350 are swingably and rotatably mounted in the guides 330-2. The second rotary member 340 may be connected to and rotated by the gear 271. The second rotary member 340 includes a second gear 340-1 engaged with the first gear 271*a* of the gear 271, and an inner gear 340-2. The inner gear 340-2 is engaged with the latch gears 350. The latch gears 350 move (swing) to engagement locations (FIG. 14B) engaged with the latches 330-1 and to disengagement locations (FIG. 14C) disengaged from the latches 330-1 based on a rotation direction of the second rotary member 340.

When the gear 271 rotates in the direction C1, the latch gears 350 swing along the guides 330-2 in the rotation direction of the second rotary member 340 and are engaged with the latches 330-1 as illustrated in FIG. 14B. In this state, the latch gears 350 do not rotate, and the first rotary member 330 rotates together with the second rotary member 340. Accordingly, the driving shaft 250 rotates in the direction D1. The movable member 220 moves, for example, toward the developer discharger 211. When the gear 271 rotates in the direction C2, the latch gears 350 swing along the guides 330-2 in the rotation direction of the second rotary member 340 and are disengaged from the latches 330-1 as illustrated in FIG. 14C. The latch gears 350 rotate in the guides 330-2. Accordingly, rotatory power of the gear 271 in the direction C2 is not transmitted to the first rotary member 330, and the driving shaft 250 does not rotate. The movable member 220 does not move. When the gear 271 rotates in the direction C1 or C2, the stirring member 240 also rotates in the direction C1 or C2.

Figure 15:
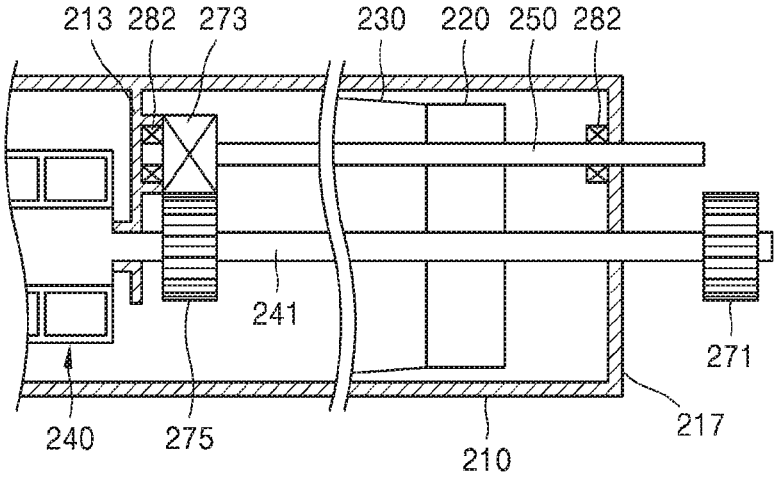
FIG. 15 is a cross-sectional view of a driving structure according to an embodiment.

FIG. 15 is a cross-sectional view of a driving structure according to an embodiment. FIG. 15 schematically illustrates the driving shaft 250 and the helical part 253 is omitted. Referring to FIG. 15, the embodiment of FIG. 15 differs from the embodiment of FIG. 12 in that the power transmission member 273 is located in the housing 210. As described above, the power transmission member 271, e.g., the gear 271, is driven by a motor provided in the body 1 or the developer cartridge 20. The driving shaft 250 is connected via the power transmission member 273 and a gear 275 to the gear 271 provided on the rotation shaft 241. As described above, the power transmission member 273 may be an electromagnetic clutch, e.g., the one-way clutch illustrated in FIG. 13 or 14A.

Figure 16:
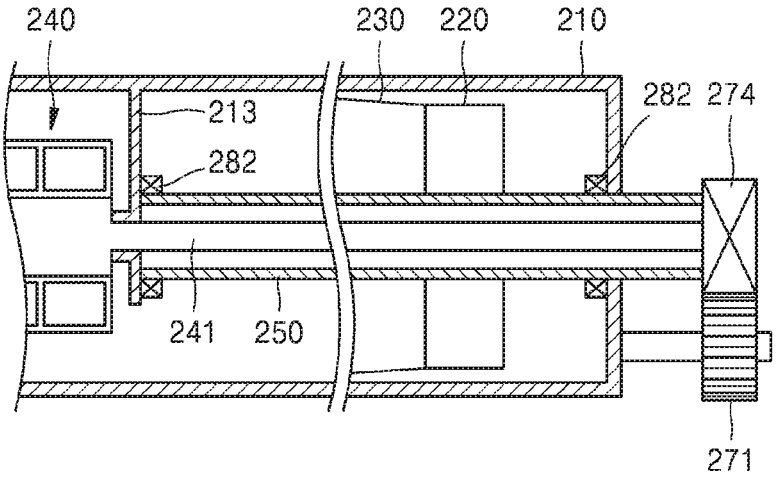
FIG. 16 is a cross-sectional view of a driving structure according to an embodiment.

FIG. 16 is a cross-sectional view of a driving structure according to an embodiment. FIG. 16 schematically illustrates the driving shaft 250 and the helical part 253 is omitted. Referring to FIG. 16, the driving shaft 250 has a pipe shape. The rotation shaft 241 of the stirring member 240 extends inside the driving shaft 250. A power transmission member 274 is mounted on ends of the driving shaft 250 and the rotation shaft 241. The power transmission member 274 may be, for example, a one-way clutch. The one-way clutch may have, for example, the structure illustrated in FIG. 13 or 14A.

When the one-way clutch illustrated in FIG. 13 is used as the power transmission member 274, the rotary member 310 may be coupled to the rotation shaft 241, and the transmission member 320 may be coupled to the driving shaft 250. The rotary member 310 may be rotated by the power transmission member 271, e.g., the gear 271, which rotates by a motor provided in the body 1 or the developer cartridge 20. Due to the above-described configuration, when the gear 271 rotates in the direction C1, the driving shaft 250 rotates in the direction D1, and the movable member 220 moves, for example, toward the developer discharger 211. When the gear 271 rotates in the direction C2, rotatory power of the gear 271 in the direction C2 is not transmitted to the transmission member 320 and the driving shaft 250, and the driving shaft 250 does not rotate. The movable member 220 does not move. When the gear 271 rotates in the direction C1 or C2, the stirring member 240 rotates in a forward or reverse direction. Also, the rotary member 310 may be rotated by a motor provided in the body 1 or the developer cartridge 20 without interposing the gear 271.

When the one-way clutch illustrated in FIG. 14A is used as the power transmission member 274, the first rotary member 330 is coupled to the driving shaft 250, and the second rotary member 340 is coupled to the rotation shaft 241. The second rotary member 340 may be connected to and rotated by the gear 271. Due to the above-described configuration, when the gear 271 rotates in the direction C1, the first rotary member 330 rotates together with the second rotary member 340. Accordingly, the driving shaft 250 rotates in the direction D1, and the movable member 220 moves, for example, toward the developer discharger 211. When the gear 271 rotates in the direction C2, rotatory power of the gear 271 in the direction C2 is not transmitted to the first rotary member 330, and the driving shaft 250 does not rotate. The movable member 220 does not move. When the gear 271 rotates in the direction C1 or C2, the stirring member 240 rotates in a forward or reverse direction. Also, the rotary member 310 may be rotated by a motor provided in the body 1 or the developer cartridge 20 without interposing the gear 271.

Figure 17:
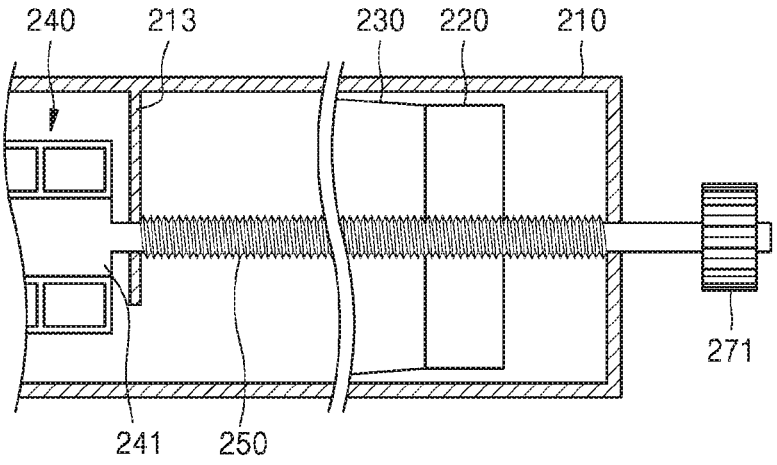
FIG. 17 is a cross-sectional view of a driving structure according to an embodiment.

FIG. 17 is a cross-sectional view of a driving structure according to an embodiment. Referring to FIG. 17, the driving shaft 250 and the rotation shaft 241 are integrated. The expression 'integrated' includes a case in which the driving shaft 250 and the rotation shaft 241 are provided as one member, and a case in which the driving shaft 250 and the rotation shaft 241 are coupled to each other on the same axis.

The power transmission member 271, e.g., a gear or a coupler, driven by a motor (not shown) provided in the body 1 or the developer cartridge 20 is coupled to an end of the driving shaft 250. When the power transmission member 271 rotates in a forward or reverse direction, the driving shaft 250 and the stirring member 240 also rotate in a forward or reverse direction together. For example, when the driving shaft 250 rotates in a forward direction, the movable member 220 may move toward the developer discharger 211. When the driving shaft 250 rotates in a reverse direction, the movable member 220 may move away from the developer discharger 211. The helical part 253 of the driving shaft 250 has a small pitch to move the movable member 220 at a low speed. For example, the pitch may be equal to or less than 3 mm. In this driving structure, the power transmission member 271 may be driven to rotate in forward and reverse directions to allow the movable member 220 to reciprocate toward and away from the developer discharger 211 by a predetermined distance from a reference location based on the amount of a developer remaining in the developer cartridge 20. The stirring member 240 continuously rotates in forward and reverse directions based on the rotation directions of the power transmission member 271.

In the structure in which the driving shaft 250 and the stirring member 240 are individually driven (FIG. 3), because the movable member 220 and the stirring member 240 may be independently driven, discharge of the developer and the location of the movable member 220 may be easily controlled.

In the structure in which the power transmission member 271 rotates in one direction and an electromagnetic clutch cuts off driving power to be transmitted to the driving shaft 250 (a case in which an electromagnetic clutch is employed as the power transmission member 273 in FIG. 12), the stirring member 240 rotates when the movable member 220 is driven.

The structure in which the driving shaft 250 selectively moves due to rotation of the power transmission member 271 in a forward or reverse direction (a case in which a one-way clutch is employed as the power transmission member 273 in FIG. 12, and FIGS. 15 and 16) rotates the stirring member 240 at a constant speed during an image printing period. When the movable member 220 needs to move, the movable member 220 is moved by changing the rotation direction of the power transmission member 271. While the movable member 220 is moving, the stirring member 240 continuously rotates by changing the rotation direction thereof. Accordingly, the movable member 220 may move even in an image printing period. In addition, the movable member 220 may move in a preparation period between two sequential image printing periods (e.g., a period between periods of printing two images when multiple images are sequentially printed).

In the structure in which the driving shaft 250 and the rotation shaft 241 of the stirring member 240 are integrated (FIG. 17), the movable member 220 reciprocates with respect to a predetermined reference location and the stirring member 240 rotates by rotating the power transmission member 271 in forward and reverse direction.

Backward motion of the movable member 220 may or may not be allowed. If the movable member 220 moves backward due to external physical impact or force, the location of the movable member 220 may not be specified and thus may not be controlled. Then, the developer may not be stably supplied to the developing unit 10 and thus a printing error may occur. Considering this, a backward motion prevention member may be employed. For instance, a one-way bearing may be employed as the backward motion prevention member. The one-way bearing is a bearing which allows rotation of only one direction and not allows rotation of an opposite direction. The structure of the one-way bearing is well known to one of ordinary skill in the art, and thus a detailed description thereof is not provided herein. As illustrated in FIGS. 12, 15, and 16, the driving shaft 250 is supported by the housing 210 by using one or more one-way bearings 282. Due to the above-described configuration, although external force is applied to rotate the driving shaft 250 in a reverse direction, i.e., a direction in which the movable member 220 moves backward, the driving shaft 250 does not rotate in a reverse direction due to the one-way bearings 282. Accordingly, location stability and reliability of the movable member 220 may be ensured.

Figure 18A:
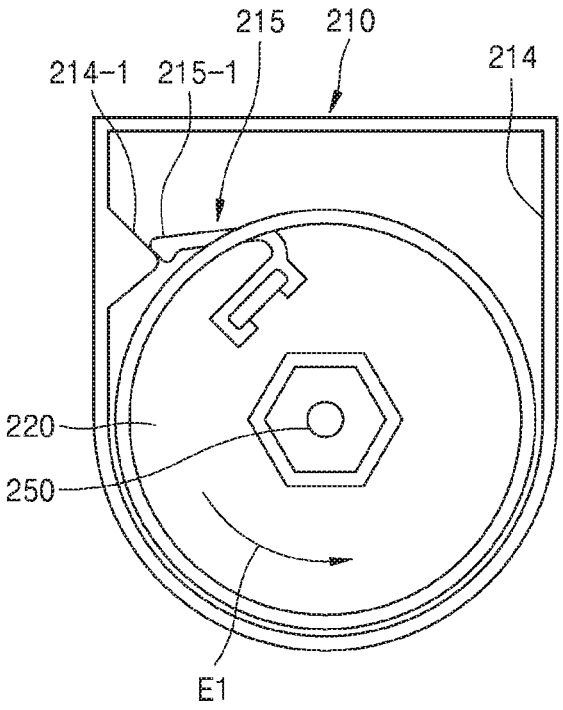
FIGS. 18A, 18B, and 18C are side views of a backward motion prevention member according to an embodiment.
Figure 18B:
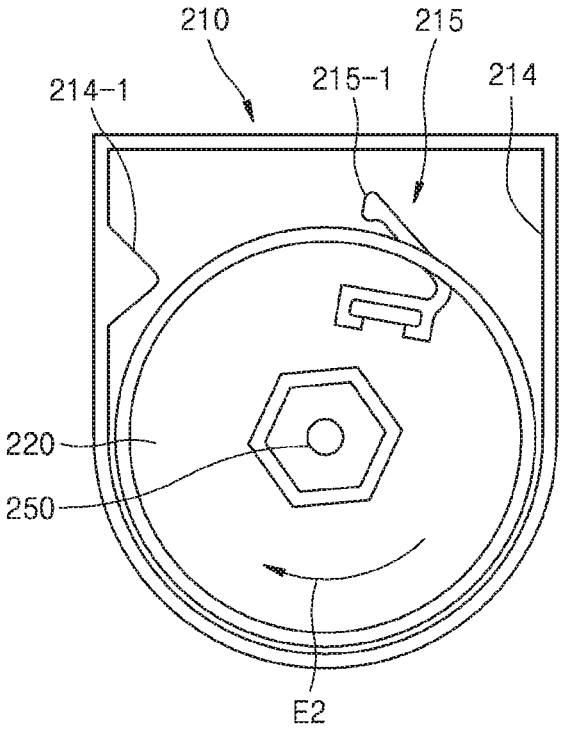
Figure 18C:
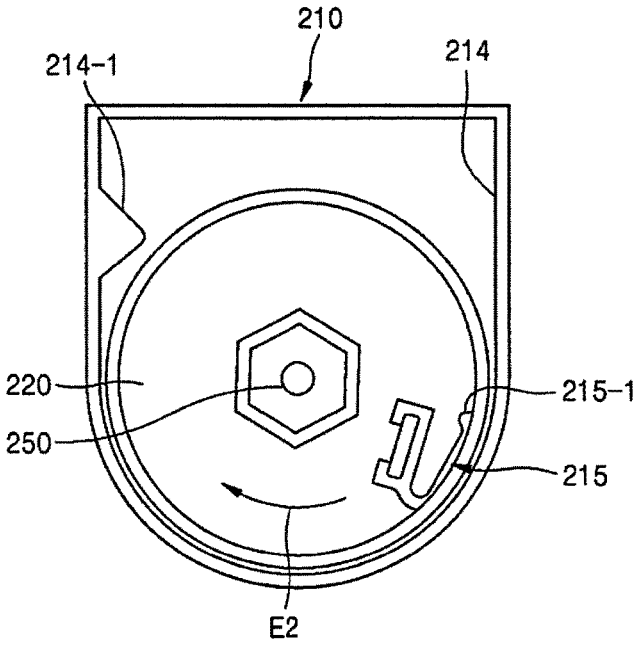

FIGS. 18A to 18C are side views of a backward motion prevention member according to an embodiment. Referring to FIGS. 18A to 18C, the backward motion prevention member may include a stopper 215 protruding outward from the movable member 220, and a locking bump 214-1 provided on the wall 214 of the housing 210. The stopper 215 may be configured as, for example, a resilient arm supported by the movable member 220. In FIG. 18A, when the driving shaft 250 rotates in a forward direction E1, i.e., a direction in which the movable member 220 moves forward, an end 215-1 of the stopper 215 is locked by the locking bump 214-1 and thus the movable member 220 does not rotates in the forward direction E1. Accordingly, when the driving shaft 250 rotates in the forward direction E1, the movable member 220 moves forward due to operation of the helical part 253 and the engagement part 221 (not shown in FIGS. 18A to 18C). In the state of FIG. 18A, the containing member 230 is maintained in a bag shape.

When the driving shaft 250 rotates in a reverse direction E2, the movable member 220 rotates in the reverse direction E2 together with the driving shaft 250 as illustrated in FIG. 18B. Accordingly, the movable member 220 does not move backward. Because the end 231 of the containing member 230 is fixed to the housing 210, when the movable member 220 rotates, the containing member 230 is twisted. Accordingly, if the containing member 230 contains a large amount of a developer, the movable member 220 slightly rotates in the reverse direction E2 and then stops rotating. In this state, although the driving shaft 250 is forced to rotate in the reverse direction E2, because the movable member 220 does not move backward due to resistance to the twist of the containing member 230, the driving shaft 250 rotates no more in the reverse direction E2. In this case, a driving load of a motor (not shown) for driving the driving shaft 250 is increased. A controller (not shown) provided in the body 1 may detect the driving load of the motor and stop driving the motor if the driving load exceeds a predetermined value. In addition, the controller may determine that an error has occurred.

In the state of FIG. 18B, when the error is solved and thus the driving shaft 250 rotates in the forward direction E1 again, the movable member 220 rotates in the forward direction E1 until the end 215-1 of the stopper 215 contacts the locking bump 214-1. When the end 215-1 of the stopper 215 contacts the locking bump 214-1 as illustrated in FIG. 18A, the movable member 220 does not rotate but moves forward as the driving shaft 250 rotates in the forward direction E1.

If the containing member 230 contains a small amount of a developer, when the driving shaft 250 rotates in the reverse direction E2, the movable member 220 may further rotate in the reverse direction E2 beyond the location of FIG. 18B. As illustrated in FIG. 18C, when the end 215-1 of the stopper 215 contacts the wall 214, the stopper 215 is resiliently bent and rotation of the movable member 220 in the reverse direction E2 is allowed. Accordingly, backward motion of the movable member 220 may be prevented. When the amount of rotation of the movable member 220 in the reverse direction E2 is increased, because the amount of twist of the containing member 230 is also increased, a large resistance is applied to the movable member 220 and the movable member 220 rotates no more. In this state, although the movable member 220 is forced to move backward, the movable member 220 may not easily move backward due to resistance of the containing member 230 and the driving load of the motor is increased. The controller provided in the body 1 may detect the driving load of the motor and stop driving the motor if the driving load exceeds a predetermined value. In addition, the controller may determine that an error has occurred.

Figure 19A:
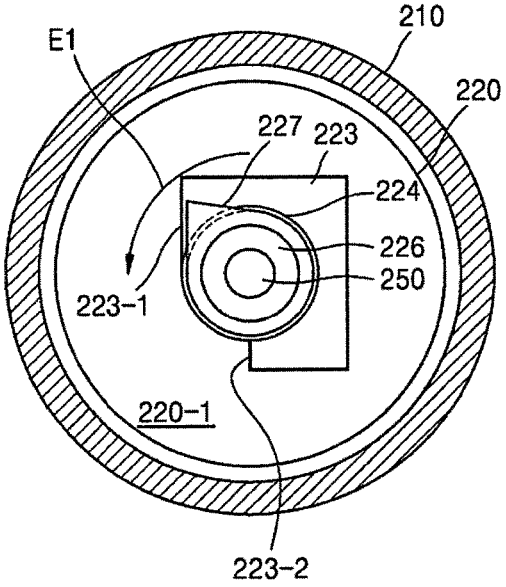
FIGS. 19A and 19B are side view of a backward motion prevention member according to an embodiment.
Figure 19B:
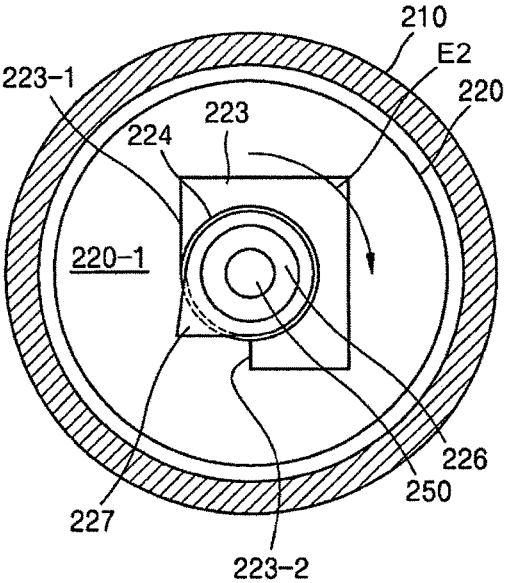

FIGS. 19A and 19B are side view of a backward motion prevention member according to an embodiment. Referring to FIGS. 19A and 19B, a bushing 226 having the engagement part 221 is inserted into the movable member 220. The bushing 226 is inserted into an insertion part 224 provided in the movable member 220 in an axial direction of the driving shaft 250. The bushing 226 is movable in the axial direction and rotatable in the insertion part 224. A stopper 227 protrudes outward from the bushing 226. A dented part 223 is dented from a side surface 220-1 of the movable member 220. The dented part 223 gradually deepens in the forward direction E1. That is, the dented part 223 is dented to the deepest level at a first end 223-1 thereof provided in the forward direction E1, and has the same level as the side surface 220-1 at a second end 223-2 thereof provided in the reverse direction E2.

As illustrated in FIG. 19A, when the driving shaft 250 rotates in the forward direction E1, although the bushing 226 is forced to rotate in the forward direction E1, the stopper 227 is locked by the first end 223-1 and thus the bushing 226 does not rotate. Accordingly, the bushing 226 and the movable member 220 move forward due to operation of the helical part 253 and the engagement part 221 (not shown in FIGS. 19A and 19B).

When the driving shaft 250 rotates in the reverse direction E2, the bushing 226 also rotates in the reverse direction E2. Because the depth of the dented part 223 is gradually reduced, the bushing 226 gradually moves backward, i.e., in a direction protruding from the side surface 220-1. When the bushing 226 moves beyond the second end 223-2 as illustrated in FIG. 19B, the stopper 227 departs from the dented part 223. Accordingly, although the bushing 226 continuously rotates in the reverse direction E2 together with the driving shaft 250, the movable member 220 does not move backward. As described above, the bushing 226, the stopper 227, and the dented part 223 may serve as the backward motion prevention member. Although not shown in FIGS. 19A and 19B, an elastic member for providing elastic force of a direction in which the bushing 226 is inserted into the dented part 223, i.e., an axial direction, may be further employed. Due to the above-described configuration, although the bushing 226 departs from the dented part 223, when the driving shaft 250 rotates in the forward direction E1 again, the bushing 226 may be inserted into the dented part 223 again and thus the movable member 220 may move forward.

Figure 20:
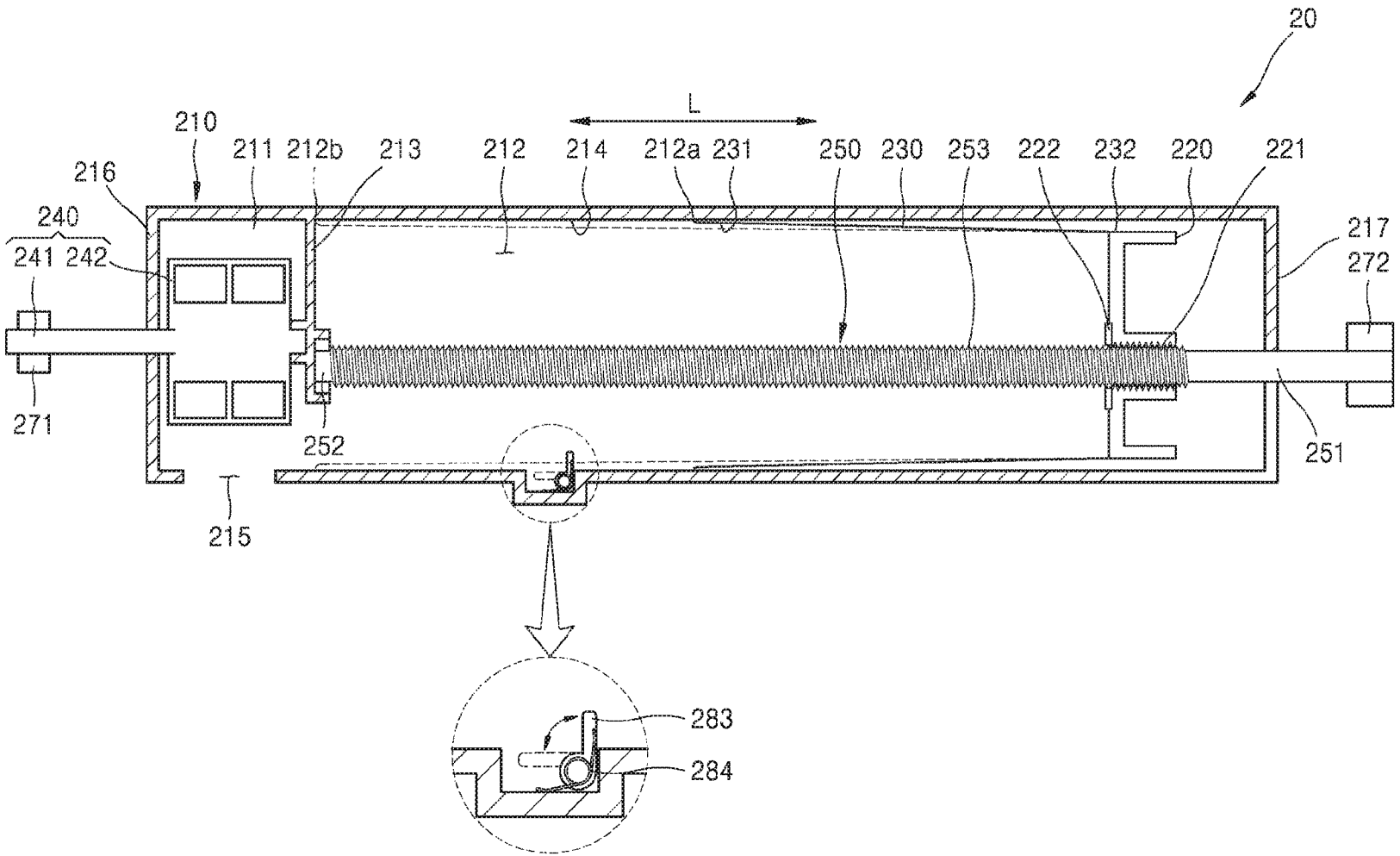
FIG. 20 is a cross-sectional view of the developer cartridge according to an embodiment.

The backward motion prevention member may be configured to prevent backward motion of the movable member 220 when the movable member 220 moves beyond a predetermined location. FIG. 20 is a cross-sectional view of the developer cartridge 20 according to an embodiment. Referring to FIG. 20, the backward motion prevention member may include a stopper 283 mounted on the housing 210 to be rotatable between a blocking position (solid line) for blocking backward motion of the movable member 220 and an allowance position (dashed line) for allowing forward motion of the movable member 220, and an elastic member 284 for applying elastic force in a direction of maintaining the stopper 283 at the blocking position. The stopper 283 may be located, for example, at a location close to the developer discharger 211. Due to the above-described configuration, when the movable member 220 moves forward, the stopper 283 is pushed by the movable member 220 to rotate to the allowance position. When the movable member 220 passes the location where the stopper 283 is mounted, the stopper 283 returns to the blocking position due to the elastic force of the elastic member 284. Accordingly, after the movable member 220 moves forward beyond the stopper 283, the movable member 220 may be locked by the stopper 283 and thus may not move backward beyond the stopper 283.

Figure 21:
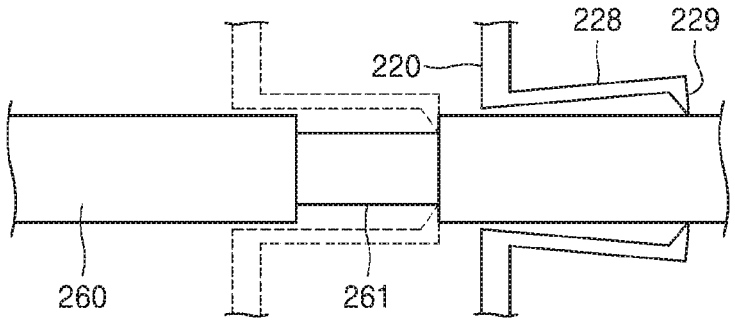
FIG. 21 is a schematic diagram of a backward motion prevention member according to an embodiment.

FIG. 21 is a schematic diagram of a backward motion prevention member according to an embodiment. Referring to FIG. 21, the backward motion prevention member may include a locking recess 261 provided in the guide member 260, and resilient arms 228 provided on the movable member 220. The resilient arms 228 extend in a backward direction, and locking bumps 229 are provided on ends thereof. When the movable member 220 moves forward, the locking bumps 229 resiliently contact the guide member 260. When the movable member 220 moves forward beyond the locking recess 261, the locking bumps 229 are resiliently locked into the locking recess 261 as indicated by a dashed line in FIG. 21. Accordingly, the movable member 220 may move forward but may not move backward.

Figure 22:
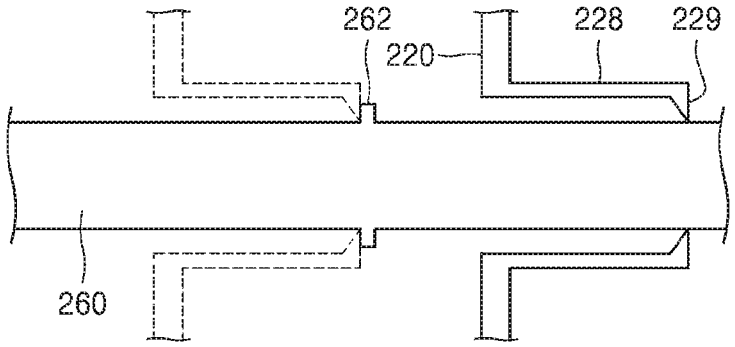
FIG. 22 is a schematic diagram of a backward motion prevention member according to an embodiment.

FIG. 22 is a schematic diagram of a backward motion prevention member according to an embodiment. The embodiment of FIG. 22 is the same as the embodiment of FIG. 21 except that protrusions 262 are provided on the guide member 260.

Figure 23:
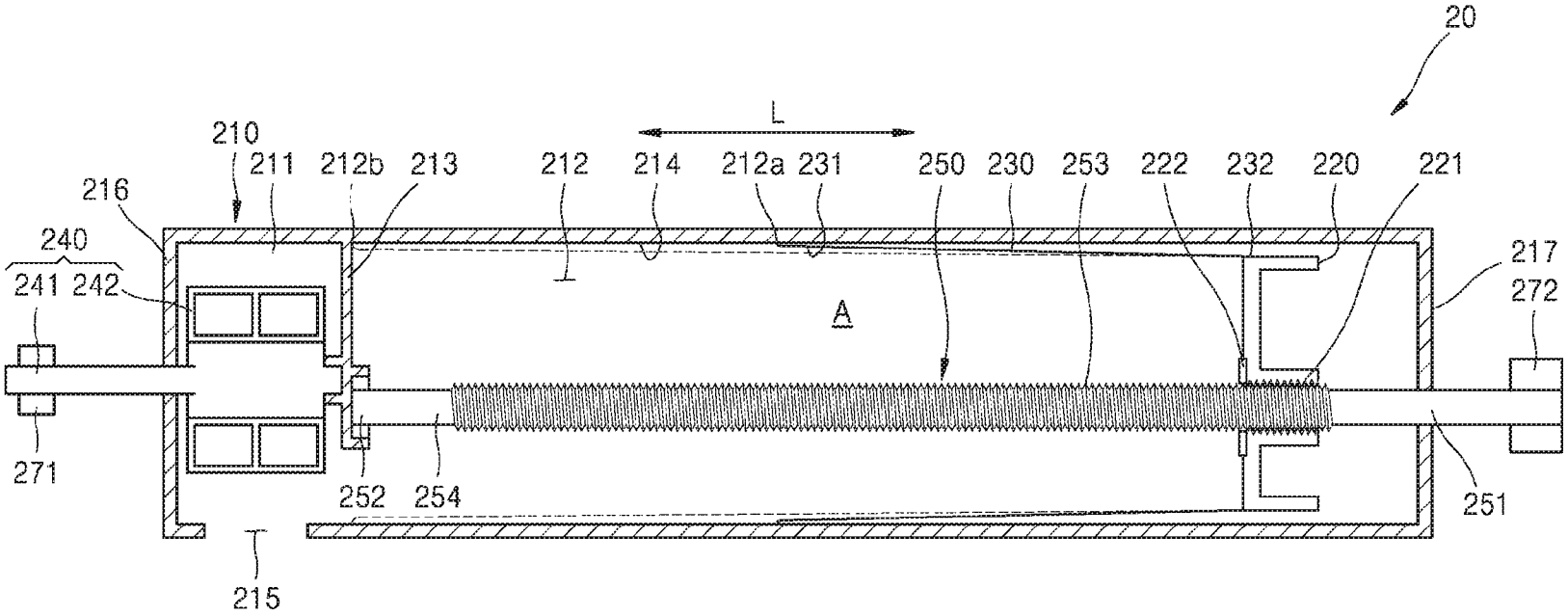
FIG. 23 is a cross-sectional view of the developer cartridge employing a backward motion prevention member, according to an embodiment.

FIG. 23 is a cross-sectional view of the developer cartridge 20 employing a backward motion prevention member, according to an embodiment. Referring to FIG. 23, a non-helical part 254 not having the helical part 253 is provided near the other end 252 of the driving shaft 250 close to the developer discharger 211. The length of the non-helical part 254 is greater than the length of the engagement part 221. Accordingly, when the movable member 220 reaches the non-helical part 254, the movable member 220 may not move forward or backward.

Figure 24:
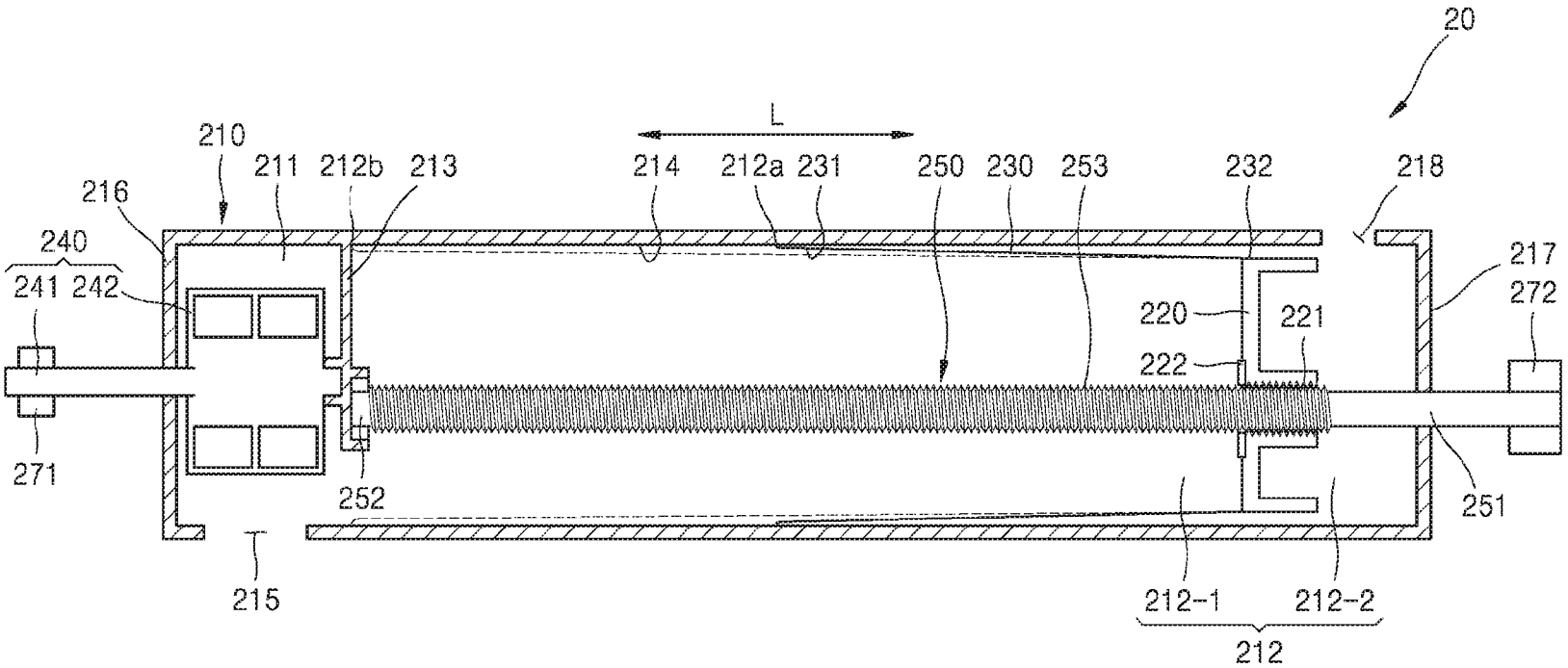
FIG. 24 is a cross-sectional view of the developer cartridge according to an embodiment.

FIG. 24 is a cross-sectional view of the developer cartridge 20 according to an embodiment. Referring to FIG. 24, the movable member 220 divides the container 212 into a first part 212-1 for containing a developer together with the containing member 230, and a second part 212-2 opposite to the first part 212-1 with respect to the movable member 220. The first and second parts 212-1 and 212-2 are disconnected from each other by the containing member 230 and the movable member 220. When the developer is consumed, the volume of the second part 212-2 is increased. Accordingly, if the second part 212-2 is efficiently used, space usability of the developer cartridge 20 and the image forming apparatus may be increased.

Referring to FIG. 24, a waste developer is contained in the second part 212-2. To this end, a waste developer inlet 218 is provided in the housing 210. The waste developer inlet 218 is connected to the waste developer container 17*a* (see FIGS. 1 and 2) by a tube (not shown). Due to the above-described configuration, because the waste developer may be contained without increasing the size of the developer cartridge 20, space usability of the developer cartridge 20 may be increased. Furthermore, because the waste developer container 17*a* requires only a small volume, the size of the developing unit 10 may be reduced. Furthermore, the body 1 does not require an additional container to contain the waste developer. Consequently, space usability of the image forming apparatus may be increased.

The embodiment of FIG. 24 may be equally applicable to the embodiments of FIGS. 4A to 4G, 7A, 7B, 8A, 8B, 9A, and 9B.

Figure 25:
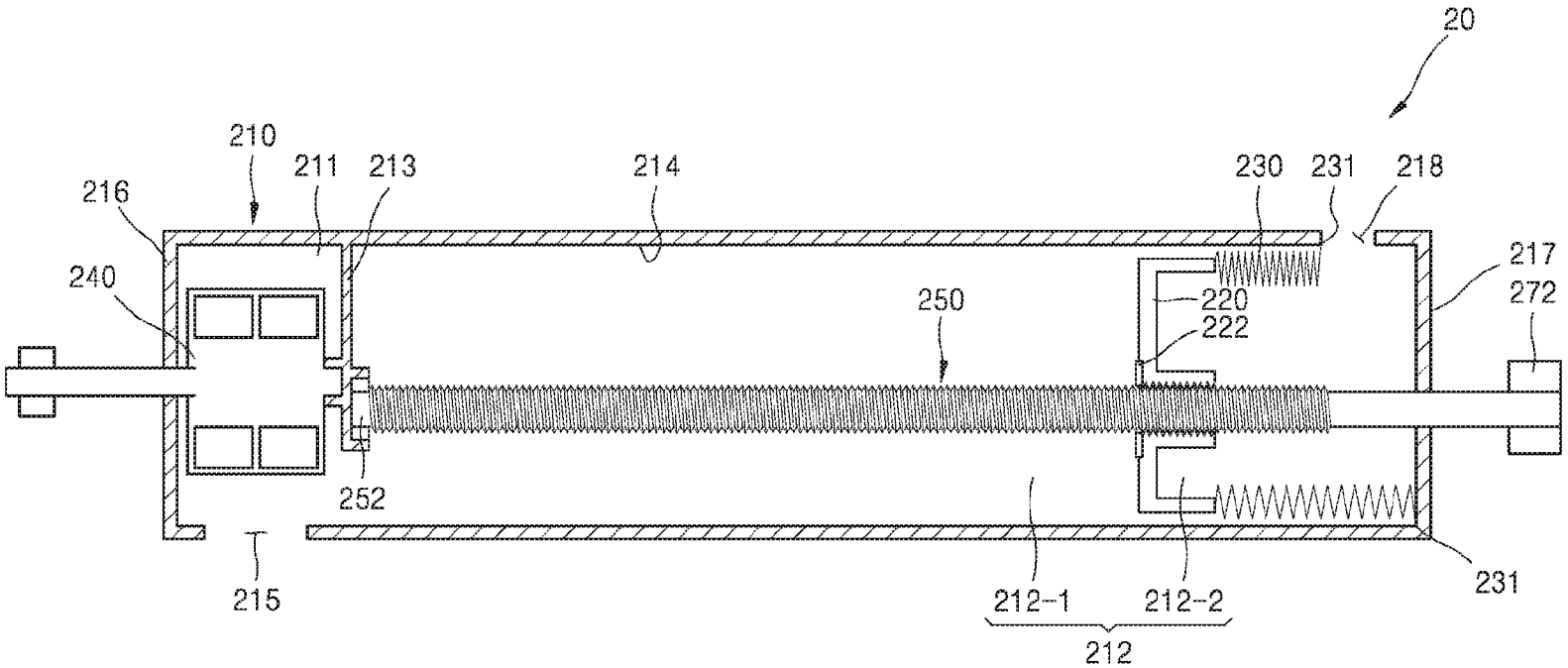
FIG. 25 is a cross-sectional view of the developer cartridge according to an embodiment.

FIG. 25 is a cross-sectional view of the developer cartridge 20 according to an embodiment. The developer cartridge 20 according to the current embodiment differs from the embodiment of FIG. 24 in that the end 231 of the containing member 230 is connected to the wall 214 of the second part 212-2. Due to the above-described configuration, the containing member 230 and the second part 212-2 configure a waste developer containing space, and a developer is contained in the first part 212-1.

While one or more embodiments have been described with reference to the figures, it will be understood by those of ordinary skill in the art that various changes in form and details may be made therein without departing from the spirit and scope as defined by the following claims.

What is claimed is:

1. A developer cartridge comprising:

a developer discharger having a developer outlet to allow developer to exit the developer discharger; and a container to store the developer and connected to the developer discharger such that the developer moves from the container to the developer discharger, the container including:

a movable member, located in the container, movable inside the container, and a flexible containing member having a first portion connected to a wall of the container and a second portion connected to the movable member to thereby divide the container into a first area to store the developer and a second area, wherein a movement of the movable member inside the container changes a size of the first area and the second area.

2. The developer cartridge of claim 1, wherein the movable member is spaced apart from the wall of the container.

3. The developer cartridge of claim 1, wherein the first area is adjacent to the developer discharger, and the movable member is located between the first area and the second area.

4. The developer cartridge of claim 3, wherein an end of the flexible containing member is connected to the wall of the container between the first area and the second area.

5. The developer cartridge of claim 3, wherein the first area is to store the developer, and wherein the second area is to store a waste developer.

6. The developer cartridge of claim 1, further comprising:

a driving shaft to move the movable member, rotatably supported by the wall, and having a helical portion; and an engagement portion provided on the movable member to engage with the helical portion.

7. The developer cartridge of claim 6, wherein the driving shaft is located at a location deviating from a geometric center of the movable member.

8. The developer cartridge of claim 6, further comprising a guide member provided in parallel with the driving shaft to guide the movable member.

9. The developer cartridge of claim 6, further comprising a backward motion prevention member to prevent a movement of the movable member in a direction away from the developer discharger.

10. The developer cartridge of claim 9, wherein the backward motion prevention member prevents a reverse rotation of the driving shaft.

11. The developer cartridge of claim 10, wherein the backward motion prevention member comprises a one-way bearing to support the driving shaft with respect to the wall.

12. The developer cartridge of claim 9, wherein the backward motion prevention member comprises:

a dented portion dented from a side surface of the movable member in an axial direction of the driving shaft, comprising a first end and a second end located in a reverse direction of the first end with respect to a rotation direction of the driving shaft, and having a level gradually increasing from the first end toward the second end and equal to the side surface at the second end;

an insertion portion provided in the dented portion;

a bushing having the engagement portion and inserted into the insertion portion to be rotatable and to be movable in the axial direction; and a stopper protruding from an outer circumference of the bushing and supported by the dented portion.

13. The developer cartridge of claim 9, wherein the backward motion prevention member comprises:

a stopper mounted on the housing to be rotatable between an allowance position for allowing a forward motion of the movable member and a blocking position for blocking a backward motion of the movable member; and an elastic member to provide an elastic force, in a direction toward the blocking position, to the stopper, wherein, as the movable member moves forward, the stopper is pushed by the movable member to rotate from the blocking position to the allowance position.

14. The developer cartridge of claim 9, further comprising a guide member provided in parallel with the driving shaft to guide the movable member, wherein the backward motion prevention member comprises:

a resilient arm provided on the movable member, and comprising a locking bump;

a locking recess provided in the guide member to lock the locking bump thereinto when the movable member moves backward.

15. The developer cartridge of claim 9, wherein the backward motion prevention member comprises a non-helical portion provided near an end of the driving shaft close to the developer discharger, and not having the helical portion.

16. The developer cartridge of claim 1, further comprising a scraper protruding inward from the container and contacting the containing member.

17. The developer cartridge of claim 1, wherein the developer discharger comprises:

a first discharger to receive a developer from the container and having mounted a stirring member therein; and a second discharger located in parallel with the first discharger, connected to the first discharger, and having provided the developer outlet therein, wherein a second stirring member configured to carry the developer received from the first discharger, to the developer outlet is mounted in the second discharger.

18. The developer cartridge of claim 17, wherein the second discharger extends under the container in a direction of gravity and is connected to the container.

19. The developer cartridge of claim 18, further comprising a scraper protruding inward from the container and contacting the containing member, wherein the scraper is located between an end of the container adjacent to the developer discharger and an end of the second discharger adjacent to the container.

20. An electrophotographic image forming apparatus comprising:

a body; and a developer cartridge to be attachable to the body, the developer cartridge comprising:

a developer discharger having a developer outlet to allow developer to exit the developer discharger, and a container to store the developer and connected to the developer discharger such that the developer moves from the container to the developer discharger, wherein the container comprises:

a movable member, located in the container, movable inside the container, and a flexible containing member having a first portion connected to a wall of the container and a second portion connected to the movable member to thereby divide the container into a first area to store the developer and a second area, wherein a movement of the movable member inside the container changes a size of the first area and the second area.

* * * * *